US006607864B2

(12) United States Patent
Serizawa et al.

(10) Patent No.: US 6,607,864 B2
(45) Date of Patent: Aug. 19, 2003

(54) IMAGE FORMING METHOD

(75) Inventors: Manabu Serizawa, Minamiashigara (JP); Katsumi Daimon, Minamiashigara (JP); Hirokazu Hamano, Minamiashigara (JP); Yuka Ishihara, Minamiashigara (JP); Norihito Fukushima, Minamiashigara (JP); Takashi Imai, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/014,555

(22) Filed: Dec. 14, 2001

(65) Prior Publication Data

US 2003/0027073 A1 Feb. 6, 2003

(30) Foreign Application Priority Data

Jun. 20, 2001 (JP) ..... 2001-187367

(51) Int. Cl.[7] ..... G03G 15/20
(52) U.S. Cl. ..... 430/124; 430/109.1; 430/111.4
(58) Field of Search ..... 430/124, 109.1, 430/109.4, 108.1, 111.4, 111.1

(56) References Cited

U.S. PATENT DOCUMENTS 5,147,747 A * 9/1992 Wilson et al. ..... 430/109
6,190,816 B1 * 2/2001 Takehara et al. ..... 430/110
6,200,720 B1 * 3/2001 Tagami ..... 430/111
6,413,691 B2 * 7/2002 Daimon et al. ..... 430/109.4

FOREIGN PATENT DOCUMENTS

| | | |
|---|---|---|
| JP | A 59-189381 | 10/1984 |
| JP | A 4-213480 | 8/1992 |
| JP | A 6-332331 | 12/1994 |
| JP | A 9-127818 | 5/1997 |
| JP | A 10-301415 | 11/1998 |
| JP | A 11-352804 | 12/1999 |
| JP | A 2000-242108 | 9/2000 |
| JP | A 2000-275982 | 10/2000 |

* cited by examiner

*Primary Examiner*—John Goodrow
(74) *Attorney, Agent, or Firm*—Oliff & Berridge, PLC

(57) ABSTRACT

An image forming method makes the warming-up time short, enables the formation of high-quality images even when fixing is performed continuously at high speed, and restrains degradations of the image quality, such as non-uniformity of gloss and non-uniformity of coloration even under high-temperature and high-humidity conditions. The method uses a toner that is wide in fixing range and is especially excellent in low-temperature fixing property. The method contains a process of melting and thereby fixing a toner image formed by unfixed toner, by heating a heating member that is in contact with the toner image. The surface of the heating member or its vicinity that is in contact with the toner image generates heat, and the toner contains at least a colorant and a binder resin having a crystalline resin with a number average molecular weight of 1500 or more as the main component.

18 Claims, 6 Drawing Sheets

IMAGE FORMING METHOD

BACKGROUND OF THE INVENTION

1. Field of the Invention

This invention concerns an image forming method that is excellent in terms of the reliability of high-quality images and can be used favorably in image formation by the electrophotography method, etc.

2. Description of the Related Art

The electrophotography method and other methods of making image information visible through electrostatic images are presently used widely in a variety of fields. Generally with the electrophotography method, an electrostatic image is developed on a photoconductor via a charging process, an exposure process, etc., and the electrostatic image is made visible via a transfer process, a fixing process, etc.

A fixing device for the fixing process is generally equipped with a heating roll, and by making a recording medium, which holds a toner image formed from unfixed toner, pass between the heating roll and a pressure roll or other member, the image is fixed onto the recording medium.

In a generally employed method of heating the heating roll, a heat-generating heater, such as a halogen lamp heater, is incorporated and the surface of the heating roll is heated by the radiant heat from the heater. However, in cases where the heat-generating heater is used as the heat source, the heat transfer efficiency is poor since heat is transferred to the heating roll via air with this structure, and the time for heating to a temperature necessary for fixing the toner (the so-called warming-up time) is thus long. Also, since both ends of the heating roll are opened, air from the exterior tends to become mixed in readily and the temperatures at the ends thus tended to be lower in comparison to the central part of the heating roll. Though there are methods in which the resistance at both ends of the heat generating part of the heat-generating heater is increased to prevent the temperature drop at both ends of the heating roll, such methods tended to make the heat generating part complex in structure and lead to such problems as increased costs, increased power consumption, etc.

As a heating roll, with which the warming-up time can be shortened and uniformity of temperature of the heating roll can be maintained, Japanese Patent Laid-Open No. 189381/1984 proposes a heating roll, with which a resistive heat generator, made of a substance that generates heat upon passage of electricity, is formed into a roller. Also, Japanese Patent Laid-open No. 213480,1992 proposes a method of passing electricity uniformly through the resistive heat generator, Japanese Patent Laid-Open No. 332331/1994 proposes a method of further shortening the warming-up time by defining the temperature coefficient of resistance of the heat-generating element, and Japanese Patent Laid-Open No. 127818/1997 proposes a method of preventing leakage of electricity during passage of electricity through the resistive heat generator. With these methods, since the surface or the vicinity of the surface f the heating roll directly heated by the resistive heat generator, the surface of the heating roll can be heated to a predetermined temperature rapidly and yet uniformly after the start of the passage of electricity through the resistive heat generator.

Generally with a fixing device that employs such a heating roll, a circular power-receiving ring member, which is electrically connected to the resistive heat generator and rotates along with the resistive heat generator, and a conducting part, which is arranged to provide electricity to the resistive heat generator via a feeding member that is in contact with the receiving ring member, are employed to pass electricity through the resistive heat generator.

Generally in the case where a heating roll, such as described above, is employed to fix a toner image, formed from unfixed toner held on a recording medium, the warming-up time is shorter in comparison to an abovementioned heating roll that employs a halogen lamp heater or other type of heat-generating heater. However, the surface temperature of this heating roll is lowered by the contact with the recording medium, and this makes it difficult to obtain the gloss and coloration demanded of the fixed image and leads to such problems as causing non-uniformity of gloss and coloration of toner image on the same recording medium. These problems become especially significant in the case where fixing is to be performed using color toners since the gloss and coloration required of color toners are generally higher than those required of a monochromatic toner.

Also, in the case where fixing is performed under high temperature and high humidity, since the moisture contained in the recording medium evaporates due to contact with the heating roll, the non-uniformity of gloss and non-uniformity of coloration are worsened. Though, for example, a method, wherein the same type of heating device is provided at the opposing pressure roll as well to restrain the temperature drop of the surface of the heating roll, may be considered for solving the above problem, this method is not adequate in effect and also has problems of increased amount of electricity conducted, etc.

Meanwhile, there is also a method wherein a conductive member is disposed at the surface or the vicinity of the surface of the heating roll and a magnetic field is made to act on the conductive member so that heat is generated at the surface or the vicinity of the surface of the heating roll by the resulting eddy current (Japanese Patent Laid-Open No. 301415/1998). Since this arrangement is one in which the surface or the vicinity of the surface of the heating roll is made to generate heat directly, the warming-up time can be shortened and the uniformity of the temperature of the heating roll can be maintained as in the case of the heating roll that uses a resistive heat generator. However, the same problems of non-uniformity of gloss and non-uniformity of coloration as the heating roll that uses a resistive heat generator still remain.

Furthermore, with regard to the amount of power required by these arrangements in which the surface or the vicinity of the surface of the heating roll is made to generate heat directly, improved efficiency is realized only for the input energy amount required for fixing. Conventionally, a binder resin for toner that is used in image forming by the electrophotography method is an amorphous resin made up of a non-crystalline resin, and in the case where image preservation under a realistic condition of approximately 50° C. is considered, the fixing temperature required for fixing is at least approximately 130° C. or more. There is thus a limit to fundamental measures for achieving low consumption power with regard to the energy required for fixing.

This problem likewise applies in the case of a method wherein a toner image formed on a photoconductor is subject to primary transfer onto an intermediate transfer medium of low non-uniformity of surface properties and electrical properties, with this primary transfer being electrostatically carried out in a successively overlaying manner in the case of multiple colors, and then the abovementioned multiple color toner image formed on the intermediate transfer medium is subject to secondary transfer onto a recording medium and thereafter fixed by a fixing device. That is, even in this case, a heating roll is generally used in the fixing device, and the same problems as the above will occur if an arrangement is employed wherein the surface or the vicinity of the surface of the heating roll is made to generate heat directly.

Furthermore, with regard to so-called simultaneous transfer and fixing methods, wherein an intermediate transfer medium, onto which a toner image formed from unfixed toner has been transferred, and a recording medium are superimposedly inserted and heat-fixed, with the toner image contacting the recording medium, between a transfer and fixing device having a pair of heating rolls and/or pressure rolls, etc., methods have been disclosed wherein a conductive member is disposed at the surface or the vicinity of the surface of the intermediate transfer medium and a magnetic field is made to act on the conductive member to make the surface or the vicinity of the surface of the intermediate transfer medium generate heat in advance by means of the resulting eddy current (Japanese Patent Laid-Open No. 352804/1999, Japanese Patent Laid-Open No. 242108/2000, Japanese Patent Laid-Open No. 275982/2000, etc.). However, since these methods also employ an arrangement wherein the surface or the vicinity of the surface of an intermediate transfer medium that contacts the toner image is made to generate heat, the surface temperature of the intermediate transfer medium is lowered by contact with the recording medium. The same problems of non-uniformity of gloss and non-uniformity of coloration thus exist as in the heating roll cases and there is also a limit in terms of measures for achieving low power consumption.

As has been described above, in all cases of an arrangement wherein in the process of fixing by heating a toner image formed from unfixed toner, the surface or the vicinity of the surface of a heating roll, intermediate transfer medium, or other heating member that contacts the toner image is made to generate heat, a temperature drop occurs when the recording medium contacts the heating member and this leads to non-uniformity of gloss and non-uniformity of coloration. Furthermore, even when any of these various heat transfer methods that are good in thermal efficiency is employed, adequate heat for melting the toner to the required degree has to be applied and thus there is a limit to fundamental measures for achieving low consumption power with regard to energy.

SUMMARY OF THE INVENTION

In view of the above circumstances, this invention therefore provides an image forming method with which the warming-up time is short and which enables high-quality images to be formed at high speed and even upon continuous fixing. This invention also provides an image forming method with which the lowering of image quality, such as non-uniformity of gloss, and non-uniformity of coloration, can be restrained especially even under high-temperature high-humidity conditions. This invention furthermore provides an image forming method that uses a toner that is wide in fixing range and is particularly excellent in low-temperature fixing property.

The image forming method according to the present invention includes a process of heating a heating member that is in contact with a toner image to thereby melt the toner and fix the toner image on the record medium. The heating member is a member with which the surface or the vicinity of the surface in contact with the toner image generates heat, and the toner contains a colorant and a binder resin, which resin containing a crystalline resin, as the main component, with a number average molecular weight of approximately 1500 or more.

Generally in comparison to a non-crystalline resin, a crystalline resin has a melting point and thus exhibits a large lowering of viscosity at a specific temperature. Since the temperature difference between the point at which the resin molecules begin thermal activity and the range in which fixing is possible can thus be made small, the resin can be made one that is excellent in low-temperature fixing property. This is an advantage that is not provided by non-crystalline resins with which the resin molecules begin thermal activity at the glass transition point and decreases in viscosity gradually.

When a crystalline resin with such characteristics is used as a binder resin for a toner, since a degree of melting that is adequate for fixing can be attained as long as a temperature greater than or equal to the melting point can be secured, the toner will be wide in fixing range and especially excellent in low-temperature fixing property.

With the present invention, a toner, having a crystalline resin with the abovementioned characteristics as the main component of the binder resin, is applied to an image forming method that uses a heating member with which the surface or the vicinity thereof generates heat in the fixing process. The benefits of shortening of warming-up time and saving of energy, which are the merits of the fixing process, are thus provided while restraining the lowering of image quality, such as non-uniformity of gloss, and non-uniformity of coloration, even when an abovementioned recording medium contacts the heating member and causes a temperature drop. Also, a low-temperature fixing property can be achieved to enable further savings in energy.

The present invention can thus prevent the lowering of image quality that is due to temperature drop of the heating member surface, resulting from contact of the heating member with a recording medium or evaporation of the moisture in the recording medium under high-temperature and high-humidity conditions, as well as that due to an inadequate amount of heat resulting from higher speeds, etc.

BRIEF DESCRIPTION OF THE DRAWINGS

Preferred embodiments of the present invention will be described in detail based on the following figures, wherein.

DETAILED DESCRIPTION OF THE INVENTION

Figure 1:
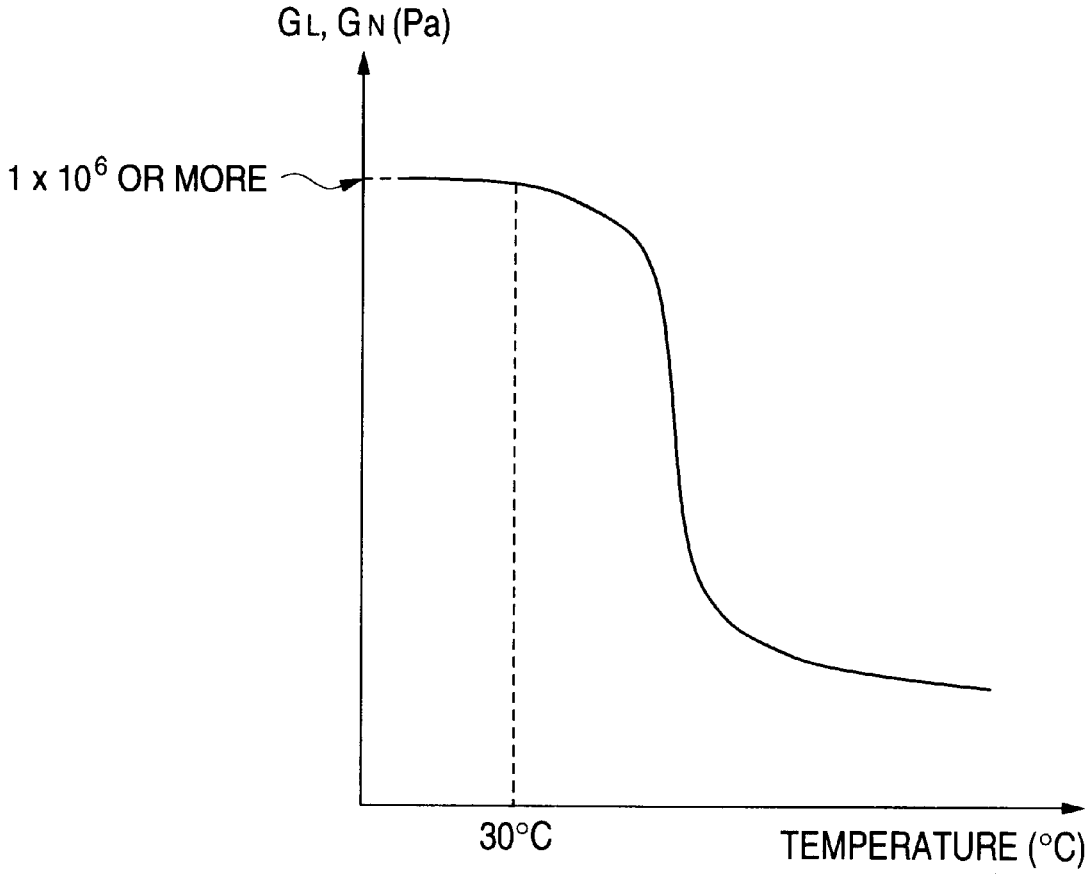
FIG. 1 is a graph, which illustrates favorable characteristics of a toner in this invention.

In the present invention, "heating member" refers to a member, which, in the fixing process or in the transfer and fixing process in the case of a simultaneous transfer and fixing method, contacts a toner image, formed by developing with developer, and causes the toner to melt, and refers specifically to a heating roll, a heating belt or other so-called heating and fixing device as well as to an intermediate transfer medium, etc., in the simultaneous transfer and fixing method. With the present invention, in the case where there are multiple heating members that come in contact with the toner image in the fixing process or transfer and fixing process (may be referred to collectively and simply as "fixing process" hereinafter), any of such heating members may be a member with which the surface or vicinity of the surface thereof generates heat.

The toner and the accompanying carrier to be used in this invention shall be described first below, the details of the fixing process shall then be described, and lastly the other processes shall be described.

Toner and Carrier

The toner to be used in this invention is used as a developer in itself when used in the form of a single-component developer or is used along with a carrier when used in the form of a two-component developer.

A. Toner

The toner in this invention is characterized in containing at least a colorant and a binder resin, which resin containing a crystalline resin as the main component, which crystalline resin having a number average molecular weight of approximately 1500 or more.

Here, "main component" refers to a component that is a major component among the components that make up the binder resin and more specifically refers to a component that makes up 50 mass % or more of the binder resin. However, with this invention, a crystalline resin, with a number average molecular weight of approximately 1500 or more, preferably makes up 70 mass % or more and more preferably makes up 90 mass % or more of the binder resin, and it is especially preferable for all of the binder resin to be made up of a crystalline resin with a number average molecular weight of approximately 1500 or more.

In the case where the resin that makes up the main component of the binder resin is not crystalline, that is, when the resin is non-crystalline, it will not be possible to maintain an anti-toner-blocking property and image preservation property while securing a good low-temperature fixing property. With this invention, a "crystalline resin" refers to a resin that exhibits not a step-like endotherm variation but a clear endothermic peak in a differential scanning calorimetrly (DSC).

Also, the number average molecular weight ($M_n$) of the crystalline resin must be approximately 1500 or more and is preferably approximately 4000 or more. A number average molecular weight ($M_n$) that is less than approximately 1500 is not preferable since the toner will then permeate into the surface of paper or other recording medium in the fixing process, causing non-uniform fixing or lowering of the strength of the fixed image against folding.

There are no restrictions in particular regarding the type of crystalline resin that makes up the main component of the binder resin of this invention as long as it is a resin with crystallinity. Crystalline polyester resins and crystalline vinyl resins can be given as specific examples, and in terms of adhesion to paper, charging property during fixing, and adjustment of the melting point within a preferable range, a crystalline polyester resin is preferable. Also, an aliphatic crystalline polyester resin with a suitable melting point is more preferable.

Examples of the abovementioned crystalline vinyl resins include vinyl resins that use a (meth)acrylic acid ester of a long-chain alkyl or alkenyl, such as amyl (meth)acrylate, hexyl (meth)acrylate, heptyl (meth)acrylate, octyl (meth) acrylate, nonyl (meth)acrylate, decyl (meth)acrylate, undecyl (meth)acrylate, tridecyl (meth)acrylate, myristyl (meth) acrylate, cetyl (meth)acrylate, stearyl (meth)acrylate, oleyl (meth)acrylate, and behenyl (meth)acrylate.

In the present specification, the expression, "(meth)acryl", shall mean that both "acryl" and "methacryl" are included.

Meanwhile, the abovementioned crystalline polyester resin is synthesized from an acid (dicarboxylic acid) component (may be referred to hereinafter as an "acid-derived component") and an alcohol (diol) component (may be referred to hereinafter as an "alcohol-derived component"). More detailed descriptions concerning the acid-derived component and the alcohol-derived component shall be given below.

Also with this invention, a copolymer, with which a component besides a polyester is copolycondensed with the above mentioned crystalline polyester main chain at a proportion of 50 mass % or less, is regarded to be a crystalline polyester as well.

Acid-Derived Component

The acid-derived component is preferably an aliphatic dicarboxylic acid and is especially preferably a straight-chain carboxylic acid. Examples include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, etc., and their lower alkyl esters and acid anhydrides. However, examples of the acid-derived component are not limited to the above.

In addition to the abovementioned aliphatic-dicarboxylic-acid-derived component, the acid-derived component preferably contains such components as a dicarboxylic-acid-derived component with double bond, a dicarboxylic-acid-derived component with sulfonic acid group, etc.

In addition to components derived from dicarboxylic acids with double bond, examples of the dicarboxylic-acid-derived component with double bond also include components derived from lower alkyl esters, acid anhydrides, etc., of dicarboxylic acids with double bond. Also, in addition to components derived from dicarboxylic acids with sulfonic acid group, examples of the dicarboxylic-acid-derived component with sulfonic acid group also include components derived from lower alkyl esters, acid anhydrides, etc., of dicarboxylic acids with sulfonic acid group.

The dicarboxylic acid with double bond can be used favorably for prevention of hot offset during the fixing process in that the double bond can be used to crosslink the entire resin. Examples of such dicarboxylic acids include fumaric acid, maleic acid, 3-hexenedioic acid, 3-octenedioic acid, etc., and such dicarboxylic acids are not limited to these examples. Examples also include lower alkyl esters, acid anhydrides, etc., of such dicarboxylic acids. Among these, fumaric acid, maleic acid, etc., are preferable in terms of cost.

An abovementioned dicarboxylic acid with sulfonic acid group is effective for improving the dispersion of the pigment and other color materials. Also, if a sulfonic acid group is present in the case where microparticles are to be prepared by emulsifying or suspending the entire resin in water, the emulsification or suspension can be achieved without the use of a surfactant as shall be described later. Examples of such dicarboxylic acids with sulfonic acid group include sodium 2-sulfoterephthalate, sodium 5-sulfoisophthalate, sodium sulfosuccinate, etc., and such dicarboxylic acids are not limited to these examples. Examples also include lower alkyl esters, acid anhydrides, etc., of such dicarboxylic acids. Among these, sodium 5-sulfoisophthalate, etc., are preferable in terms of cost.

The content of these acid-derived components (dicarboxylic-acid-derived component with double bond and/or dicarboxylic-acid-derived component with sulfonic acid group) besides the aliphatic dicarboxylic-acid-derived component among the acid-derived components is preferably 1 to 20 constituent mole % and more preferably 2 to 10 constituent mole %.

When the abovementioned content is less than 1 constituent mole %, the dispersion of pigment may not be good and the emulsion particle diameter may become large, thus making the adjustment of the toner diameter by aggregation difficult. Meanwhile, when the content exceeds 20 constituent mole %, the crystallinity of the polyester resin may drop and the melting point may drop, making the image preservation property poor and causing the emulsion particle diameter to become too small and thereby causing the resin to dissolve in water and preventing the formation of a latex.

With the present invention, "constituent mole %" refers to the percentage determined with the amount of a component (acid-derived-component or alcohol-derived-component) in the polyester resin being set equal to one unit (mole).

Alcohol-Derived Component

An aliphatic diol is preferable as the alcohol component. Examples include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, etc. However, examples of an aliphatic diol are not limited to the above.

The abovementioned alcohol-derived component preferably contains an aliphatic-diol-derived component at an amount of 80 constituent mole % or more and may contain other components as necessary. For the alcohol-derived component, the content of aliphatic-diol-derived component is preferably 90 constituent mole % or more.

When the abovementioned content is less than 80 constituent mole %, since the crystallinity of the polyester resin is lowered and the melting point is lowered, the anti-toner-blocking property, image preservation property, and low-temperature fixing property may become poor.

Diol-derived-components with double bond and diol-derived-components with sulfonic acid group may be given as other components that may be contained as necessary.

Examples of the diol with double bond include 2-butene-1,4-diol, 3-butene-1,6-diol, 4-butene-1,8-diol, etc.

Meanwhile, examples of the diol with sulfonic acid group include benzene 1,4-dihydroxy-2-sulfonate sodium salt, benzene 1,3-dihydroxymethyl-5-sulfonate sodium salt, 2-sulfo-1,4-butanediol sodium salt, etc.

The content of these alcohol-derived components (diol-derived components with double bond and/or diol-derived components with sulfonic acid group) besides the straight-chain-aliphatic-diol-derived components among the alcohol-derived components is preferably 1 to 20 constituent mole % and more preferably 2 to 10 constituent mole %. When the content is less than 1 constituent mole %, the dispersion of pigment may not be good and the emulsion particle diameter may become large, thus making the adjustment of the toner diameter by aggregation difficult. Meanwhile, when the content exceeds 20 constituent mole %, the crystallinity of the polyester resin may be lower and the melting point may be lower, making the image preservation property poor and causing the emulsion particle diameter to become too small and thereby causing the resin to dissolve in water and preventing the formation of a latex.

Furthermore, the abovementioned crystalline polyester resin is preferably a crystalline polyester resin with which the ester concentration M, as defined below (Eq. 1), is approximately 0.01 or more and 0.2 or less.

$$M=K/A \qquad \text{(Eq. 1)}$$

(In the above equation, M indicates the ester concentration, K indicates the number of ester groups in the polymer, and A indicates the number of atoms that make up the macromolecular chain of the polymer.)

Here, the "ester concentration M" is an indicator that indicates the proportion of ester groups contained in a crystalline polyester resin polymer.

The "number of ester groups in the polymer," expressed by K in the above equation, indicates, in other words, the number of ester bonds contained in the entire polymer.

The "number of atoms that make up the macromolecular chain of the polymer," expressed by A in the above equation, is the total number of atoms that make up the macromolecular chain of the polymer and though this includes the number of all atoms that contribute to the ester bonds, it does not include the number of atoms in branched portions of other constituent parts. That is, though the carbon atoms and oxygen atoms that originate from the carboxyl groups and alcohol groups that contribute to the ester bonds (2 oxygen atoms are contained in an ester bond) and for example, the six carbons of an aromatic ring that is part of the macromolecular chain are included in the above calculation of the number of atoms, for example the hydrogen atoms in an aromatic ring or alkyl group that is a part of the macromolecular chain and atoms and atom groups of substituents of such hydrogen atoms are not included in the above calculation of the number of atoms.

To give a specific example, of the total of 10 atoms, that is, the 6 carbon atoms and 4 hydrogen atoms in an arylene group that makes up a macromolecular chain, only the 6 carbon atoms are included in the abovementioned "number of atoms A that make up the macromolecular chain of the polymer," and even if a hydrogen is substituted by some substituent, the atoms that make up the substituent are not included in the "number of atoms A that make up the macromolecular chain of the polymer."

In the case where the crystalline polyester resin is a homopolymer that is made up of one type of repeated unit (for example, if a polymer is expressed as $H—[OCOR^1COOR^2O—]_n—H$, the one type of repeated unit is that expressed in [ ]), since two ester bonds exist in the one type of repeated unit (that is, the number of ester groups K' in the repeated unit=2), the ester concentration M can be determined by the following Equation (1-1):

$$M=2/A' \quad \text{(Eq. 1-1)}$$

(In the above equation, M indicates the ester concentration and A' indicates the number of atoms that make up the macromolecular chain in one type of repeated unit.)

Also, in the case where the crystalline polyester resin is a copolymer that contains several copolymerized units, the ester concentration can be determined by determining the number of ester groups $K^x$ and the number of atoms $A^x$ that make up the macromolecular chain of each copolymerized unit, totaling these upon multiplying by the respective copolymerization ratio, and substituting into (Eq. 1) given above. For example, the ester concentration M of a compound $[(Xa)_a(Xb)_b(Xc)_c]$ having the three copolymerized units of Xa, Xb, and Xc at a copolymerization ratio a: b: c (where a+b+c=1) can be determined by the following Equation (1-2).

$$M=\{K^{Xa}\times a+K^{Xb}\times b+K^{Xc}\times c\}/\{A^{Xa}\times a+A^{Xb}\times b+A^{Xc}\times c\} \quad \text{(Eq. 1-2)}$$

(In the above equation, M indicates the ester concentration, $K^{Xa}$ indicates the number of ester groups in copolymerized unit Xa, $K^{xb}$ indicates the number of ester groups in copolymerized unit Xb, $K^{Xc}$ indicates the number of ester groups in copolymerized unit Xc, $A^{Xa}$ indicates the number of atoms that make up the macromolecular chain in copolymerized unit Xa, $A^{Xb}$ indicates the number of atoms that make up the macromolecular chain in copolymerized unit Xb, and $A^{Xc}$ indicates the number of atoms that make up the macromolecular chain in copolymerized unit Xc.)

For the toner in the present invention, it is preferable for the ester concentration M, as defined by the abovementioned (Eq. 1), in the crystalline polyester resin to be used as the binder resin to be approximately 0.01 or more and 0.2 or less in terms of improving the property of attachment onto paper.

There are no particular restrictions concerning the method of producing the polyester resin, and the resin may be produced by a general polyester polymerization method in which an acid component and an alcohol component are reacted. Examples of methods include the direct condensation polymerization method, ester interchange method, etc., and a method is selected and used according to the type of monomer. Though the molar ratio (acid component/alcohol component) for reacting the acid component and alcohol component cannot be set unconditionally as it depends on the reaction conditions, etc., it is normally approximately 1/1.

The production of the abovementioned polyester resin can be performed at a polymerization temperature between 180° C. and 230° C., and where necessary, the reaction system is depressurized and the reaction is made to proceed while removing the water and alcohol that are generated in the condensation process.

When the monomer does not dissolve or is not compatibilized under the reaction temperature, a solvent of high boiling point may be added as a dissolution aid for achieving dissolution. The polymerization condensation reaction is carried out while distilling out the dissolution aid. In the case where a monomer of poor compatibility exists in the copolymerization reaction, the monomer of poor compatibility and the acid or alcohol that is to undergo condensation polymerization with this monomer may be condensed in advance and then subject to condensation polymerization with the main component.

Catalysts that can be used in the production of the polyester resin include compounds of alkali metals, such as sodium, and lithium, compounds of alkali earth metals, such as magnesium, and calcium, compounds of metals, such as zinc, manganese, antimony, titanium, tin, zirconium, and germanium, phosphite compounds, phosphate compounds, amine compounds, etc. Specific compounds include the following.

That is, compounds, such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin chloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl) phosphite, ethyltriphenylphosphonium bromide, triethylamine, triphenylamine, etc., can be given as examples.

The melting point of the crystalline resin that is the main component of the binder resin in this invention is preferably approximately 50 to 120° C. and more preferably approximately 60 to 110° C. If this melting point is less than 50° C., there may be problems in the preservation property of the toner and the preservation property of the toner image after fixing. On the other hand, if the melting point is higher than 120° C., adequate low-temperature fixing may not be achieved in comparison to prior-art toners.

For the measurement of the melting point of the crystalline resin in this invention, a differential scanning calorimeter (DSC) can be used to carry out a measurement from room temperature to 150° C. at a temperature raising rate of 10° C. per minute and the melting point can be determined as the fusion peak temperature of input-compensated differential scanning calorimetry as indicated in JIS K-712. Though a crystalline resin may exhibit plural fusion peaks, the melting point is determined from the maximum peak with this invention.

Besides the polymerizable monomers mentioned above, a compound with a shorter-chain alkyl group, alkenyl group, aromatic ring, etc., may be used for the purpose of adjusting the melting point, molecular weight, etc., of the crystalline resin that is the main component of the binder resin in this invention. Specific examples of dicarboxylic acids that can be used in this manner include alkyl dicarboxylic acids, such as succinic acid, malonic acid, and oxalic acid, aromatic dicarboxylic acids, such as phthalic acid, isophthalic acid, terephthalic acid, homophthalic acid, 4,4'-bibenzoic acid, 2,6-naphthalenedicarboxylic acid, and 1,4-naphthalenedicarboxylic acid, and nitrogen-containing aromatic dicarboxylic acids, such as dipicolic acid, dinicotinic acid, quinolic acid, and 2,3-pyrazinedicarboxylic acid, specific examples of short-chain alkyl diols that can be used in the above manner include succinic acid, malonic acid, acetonedicarboxylic acid, diglycolic acid, etc., and specific examples of short-chain alkyl vinyl polymerizable monomers include (meth)acrylic acid esters of short-chain alkyls and alkenyls, such as methyl (meth) acrylate, ethyl (meth)acrylate, propyl (meth)acrylate, and butyl (meth)acrylate, vinylnitriles, such as acrylonitrile, and methacrylonitrile, vinyl ethers, such as vinyl methyl ether, and vinyl isobutyl ether, vinyl methyl ketone, vinyl ethyl ketone, vinyl isopropenyl ketones, and olefins, such as ethylene, propylene, butadiene, and isoprene.

One type of such a polymerizable monomer may be used solitarily or two or more types may be used in combination.

With this invention, a compound with a hydrophilic polar group may be used as long as it is copolymerizable as a resin for toner for electrostatic image development. Specific examples of such a compound in the case where the resin to be used is a polyester include sulfonyl-terephthalic acid sodium salt, 3-sulfonyl-isophthalic acid sodium salt, and other dicarboxylic acid compounds with which a sulfonyl group is directly substituted to an aromatic ring. In the case where the resin is a vinyl resin, specific examples include unsaturated aliphatic carboxylic acids, such as (meth)acrylic acid, and itaconic acid, esters of (meth)acrylic acid and an alcohol, such as glycerol mono(meth)acrylate, fatty-acid-modified glycidyl (meth)acrylate, zinc mono(meth)acrylate, zinc di(meth)acrylate, 2-hydroxyethyl (meth)acrylate, polyethylene glycol (meth)acrylate, and polypropylene glycol (meth)acrylate, styrene derivatives having a sulfonyl group on any of the ortho-, meta-, and para- positions, and sufonyl-group-substituted aromatic vinyls, such as a sufonyl-group-containing vinylnaphthalene.

A crosslinking agent may be added to the binder resin in this invention for the purpose of preventing non-uniformity of gloss, non-uniformity of coloration, hot offset, etc., in the process of fixing at a high temperature range. Specific examples of crosslinking agents include

- aromatic multivinyl compounds, such as divinylbenzene, and divinylnaphthalene,
- multivinyl esters of aromatic polyvalent carboxylic acids, such as divinyl phthalate, divinyl isophthalate, divinyl terephthalate, divinyl homophthalate, divinyl/trivinyl trimesate, divinyl napthalenedicarboxylate, and divinyl biphenylcarboxylate,
- divinyl esters of nitrogen-containing aromatic compounds, such as divinyl pyridinedicarboxylate,
- unsaturated heterocyclic compounds, such as pyrrole, thiophene,
- vinyl esters of unsaturated heterocyclic compound carboxylic acids, such as vinyl pyromucate, vinyl furancarboxylate, vinyl pyrrole-2-carboxylate, and vinyl thiophenecarboxylate,
- (meth)acrylic acid esters of straight-chain polyvalent alcohols, such as butanediol methacrylate, hexanediol methacrylate, octanediol methacrylate, decandediol methacrylate, and dodecanediol methacrylate,
- (meth)acrylic acid esters of branched and substituted polyvalent alcohols, such as neopentyl glycol dimethacrylate, 2-hydroxy, and 1,3-diacryloxypropane,
- polyethylene glycol di(meth)acrylates, polypropylene polyethylene glycol di(meth)acrylates, and
- multivinyl esters of polyvalent carboxylic acids, such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacinate, divinyl dodecanedioic acid, and divinyl brassylate.

Also, especially in the case where the crystalline resin is a polyester, a method may be used wherein fumaric acid, maleic acid, itaconic acid, trans-aconitic acid or other unsaturated polycarboxylic acid is copolymerized in the polyester and the multiple bond parts in the resin are thereafter crosslinked, either to each other or by using another vinyl compound.

With this invention, one type of such a crosslinking agent may be used solitarily or two or more types may be used in combination.

The method of crosslinking using a crosslinking agent may be a method wherein the polymerizable monomer is polymerized and crosslinked together with the crosslinking agent or a method wherein a resin is polymerized with unsaturated parts remaining in the resin and the unsaturated parts are crosslinked by a crosslinking reaction after preparation of the toner.

In the case where the resin that is used is a polyester, the polymerizable monomer can be polymerized by condensation polymerization.

A known catalyst for the condensation polymerization may be used. Specific examples include titanium tetrabutoxide, dibutyltin oxide, germanium dioxide, antimony trioxide, tin acetate, zinc acetate, tin disulfide, etc., In the case where the resin that is used is a vinyl resin, the polymerizable monomer can be polymerized by radical polymerization.

There are no restrictions in particular concerning the initiator for use in the radical polymerization as long as it enables emulsion polymerization. Specific examples include:

- peroxides, such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium peroxide, sodium peroxide, potassium peroxide, diisopropyl peroxicarbonate, tetralin hydroperoxide, 1-phenyl-2-methylpropyl-1-hydroperoxide, pertriphenylacetic acid-tert-butyl-hydroperoxide, tert-butyl performate, tert-butyl peracetate, tert-butyl perbenzoate, tert-butyl perphenylacetate, tert-butyl permethoxyacetate, and tert-butyl per-N-(3-toluyl)carbamate,
- azo compounds, such as 2,2'-azobispropane, 2,2'-dichloro-2,2'-azobispropane, 1,1'-azo(methylethyl) diacetate, 2,2'-azobis(2-amidinopropane) hydrochloride, 2,2'-azobis(2-amidinopropane) nitrate, 2,2'-azobisisobutane, 2,2'-azobisisobutylamide, 2,2'-azobisisobutyronitirile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitirile, 2-(4-bromophenylazo)-2-arylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenolA-4,4'-azobis-4-cyanopentanoate), and poly(tetraethylene glycol-2,2'-azobisisobutyrate), and
- 1,4-bis(pentaethylene)-2-tetrazene, 1,4-dimethoxycarbonyl -1,4-diphenyl-2-tetrazene, etc.

An abovementioned polymerization initiator may also be used as an initiator for the crosslinking reaction in the abovementioned crosslinking process.

Though the colorant to be used in this invention may either be a dye or a pigment, a pigment is preferable from the standpoint of light resistance and water resistance. Preferably at least one or more types of pigment selected from among cyan, magenta, and yellow pigments are contained. A single pigment may be used solitarily or two or more pigments of the same type may be used upon mixing. Furthermore, two or more pigments of the different type may be used upon mixing. Known pigments that can be used favorably include carbon black, aniline black, aniline blue, ultramarine blue, chalcoyl blue, chrome yellow, quinoline yellow, benzidine yellow, Hansa yellow, threne yellow, permanent orange GTR, pyrazolone orange, vulcan orange, Du Pont oil red, pyrazolone red, lithol red, Watchung red, permanent red, brilliant carmine 3B, brilliant carmine 6B, rhodamine B lake, lake red C, methylene blue chloride, phthalocyan blue, phthalocyanine green, malachite green oxalate, lamp black, rose Bengal, quinacridone, C. I. pigment red 48:1, C. I. pigment red 57:1, C. I. pigment red 122, C. I. pigment red 185, C. I. pigment yellow 12, C. I. pigment yellow 17, C. I. pigment yellow 180, C. I. pigment yellow 97, C. I. pigment yellow 74, C. I. pigment blue 15:1, C. I. pigment blue 15:3, etc. Also various dyes, such as acridine, xanthene, azo, benzoquinone, azine, anthraquinone, dioxazine, thiazine, azomethine, indigo, thioindigo, phthalocyanine, aniline black, polymethine, triphenylmethane, diphenylmethane, thiazole, and xanthene dyes, may also be used. A black pigment or dye, such as carbon black, may be mixed in such a colorant to a degree where the transparency will not be lowered.

A magnetic powder may also be used as a colorant. Known magnetic powders that can be used include those of ferromagnetic metals, such as cobalt, iron, and nickel; alloys of cobalt, iron, nickel, aluminum, lead, magnesium, zinc, manganese, etc., and oxides, etc.

One type of such a colorant may be used solitarily or two or more types may be combined and used. The content of the colorant with respect to 100 mass parts of the abovementioned binder resin is preferably 0.1 to 40 mass parts and more preferably 1 to 30 mass parts.

By appropriate selection of the abovementioned types of colorants, toners of various colors, such as yellow toner, magenta toner, cyan toner, and black toner, can be obtained.

In addition to the abovementioned essential components, known additives, etc., may be selected suitably and used in accordance with the purpose as other components in the toner of this invention. Examples of such additives include various internal additives, release agents, charge controlling agents, inorganic fine particles, organic fine particles, lubricants, abrasives, and other various known additives.

Examples of the internal additive include magnetic substances, such as ferrite, magnetite, reduced iron, cobalt, manganese, nickel, and other metals, alloys, and compounds that contain such metals, and as the amount added, an amount that will not damage the charging characteristics of the toner can be used.

The abovementioned charge controlling agent is generally used for the purpose of improving the charging property. Though there are no particular restrictions in regard to the charge controlling agent, a colorless or pale-colored agent is preferably used, especially in the case where a color toner is used. Examples of charge controlling agents that can be used include dyes, which contain a complex of a quaternary ammonium salt compound, nigrosine compound, aluminum, iron, chromium, etc., triphenylmethane pigments, chromium azo dyes, iron azo dyes, aluminum azo dyes, salicylic acid metal complexes, etc.

The abovementioned inorganic fine particles are generally used for the purpose of improving the fluidity of the toner. As the inorganic fine particles, silica fine particles, titanium oxide fine particles, alumina fine particles, cerium oxide fine particles, calcium carbonate, magnesium carbonate, tricalcium phosphate, fine particles obtained by treating and making the surfaces of such fine particles hydrophobic, or other type of known fine particles may be used solitarily or two or more types of such fine particles may combined and used. From the standpoint of not damaging the coloration property and the OHP transmission and other transparent properties, silica fine particles, which are lower in refractive index than the binder resin, are preferable. The silica fine particles may subject to various forms of surface treatment, and for example, silica fine particles that have been surface treated with a silane coupling agent, titanium coupling agent, silicone oil, etc., are preferable.

By internally adding such inorganic fine particles, the viscoelasticity of the toner can also be adjusted, and in this case, the image gloss and permeation into paper can be adjusted. Inorganic fine particles are preferably contained in the raw materials at an amount of 0.5 to 15 mass % and more preferably 1 to 10 mass %.

The abovementioned organic fine particles are generally used to improve the cleaning property and transfer property. Examples of the organic fine particles include vinyl resin particles, polyester resin particles, silicone resin particles, and all other particles that are normally used as an external additive for the toner surface. Examples also include microparticles of polystyrene, polymethyl methacrylate, polyfluorovinylidene, etc.

These inorganic fine particles and organic fine particles may also be used as fluidity aids, cleaning aids, etc.

Examples of the abovementioned lubricant include fatty acid amides, such as ethylene-bis-stearic acid amide, and oleic acid amide, metal salts of fatty acids, such as zinc stearate, and calcium stearate.

Examples of the abovementioned grinding agent include silica, alumina, cerium oxide, etc.

The content of the abovementioned other components may be of any level as long as the objects of this invention are not impaired, and the content is generally an extremely small amount, specifically 0.01 to 5 mass %, and preferably 0.5 to 2 mass %.

The abovementioned release agent is generally used for the purpose of improving the release property. Examples of the release agent include low-molecular-weight polyolefins, such as polyethylene, polypropylene, and polybutene; silicones that exhibit a softening point upon heating; fatty acid amides, such as oleic acid amide, erucic acid amide, ricinoleic acid amide, and stearic acid amide; vegetable waxes, such as carnauba wax, rice wax, candelilla wax, tallow, and jojoba oil; animal waxes, such as beeswax; and mineral and petroleum waxes, such as montan wax, ozokerite, ceresin, paraffin wax, microcrystalline wax, and Fischer-Tropsch wax. With this invention, one type of such a release agent may be used solitarily or two or more types may be used in combination.

The added amount of such a release agent with respect to the total amount of toner is preferably approximately 0.5 to 50 mass %, more preferably approximately 1 to 30 mass %, and even more preferably approximately 5 to 15 mass %. If the added amount is less than 0.5 mass %, there is no effect of adding a release agent, and an added amount of 50 mass % or more is not preferable since the charging property tends to be affected and the toner tends to break readily in the interior of developing machine, not only leading to such effects as the release agent becoming spent on the carrier, the charging property becoming reduced readily, but also, in the case where for example a color toner is used, causing inadequate permeation into the image surface during fixing and making the release agent tend to reside in the image, thereby causing the transparency to become poor.

The toner in this invention has a volume-average particle diameter of preferably 1 to 12 μm, more preferably 3 to 10 μm, and even more preferably 3 to 8 μm. With regard to the number-average particle diameter, 1 to 10 μm is preferable and 2 to 8 μm is more preferable. Also, as the value of (volume-average particle diameter)÷(number-average particle diameter), which is an index of the particle size distribution, 1.6 or less is preferable and 1.5 or less is even more preferable. If this value is greater than 1.6, since the spread of the particle size distribution will be large, the distribution of charging will also be broad and thus a toner of reverse polarity or low-charge toner may be produced.

The volume-average particle diameter and number-average particle diameter may be measured using, for example, the Coulter Counter Type [TA-II] (made by Coulter Inc.) with a 50 μm-diameter aperture. In this case, measurement is made after dispersing the toner in an aqueous electrolytic solution (aqueous isotonic solution) and dispersing by ultrasonic waves for 30 seconds or more.

Preferable Physical Properties of the Toner in this Invention

The toner in this invention should have adequate hardness under room temperature. To be more specific, the dynamic viscoelastic properties of the toner at an angular frequency of 1 rad/sec and 30° C. are preferably a storage elastic modulus $G_L(30)$ of approximately $1\times10^6$Pa or more and a loss elastic modulus $G_N(30)$ of approximately $1\times10^6$ Pa or more. The details of the storage elastic modulus $G_L$ and the loss elastic modulus $G_N$ are defined in JIS K-6900.

When the storage elastic modulus $G_L(30)$ is less than $1\times10^6$Pa or the loss elastic modulus $G_N(30)$ is less than $1\times10^6$Pa at an angular frequency of 1 rad/sec and 30° C., the toner particles may become deformed by the pressure or shearing force applied by a carrier when mixed with a carrier in a developing machine and thus may not be able to maintain stable charge developing characteristics. The toner may also become deformed by the shearing force applied by a cleaning blade in the process of cleaning the toner on a latent image holding member (photoconductor) and cause poor cleaning.

It is preferable for the storage elastic modulus $G_L(30)$ and loss elastic modulus $G_N(30)$ at an angular frequency of 1 rad/sec and 30° C. to be in the ranges given above since the characteristics in the fixing process will be stable even when the toner is used in a high-speed electrophotographic device.

Furthermore, the toner in this invention preferably has a temperature area in which the values of the storage elastic modulus $G_L$ and the loss elastic modulus $G_N$ vary by a temperature change by approximately 1000 or more within a temperature range of approximately 10° C. (that is, a temperature area in which when the temperature is raised by 10° C., the values of $G_L$ and $G_N$ change to values that are one thousandth or less the values prior to the temperature rise). If there is no such temperature area for the storage elastic modulus $G_L$ and the loss elastic modulus $G_N$, the fixing temperature will be high and, as a result, insufficient for lowering the energy consumption of the fixing process.

Also, the toner in this invention preferably has a melt viscosity at 120° C. of 100Pa·S or more so that the offset resistance will be good.

FIG. 1 is a graph that shows the preferable characteristics of the toner in this invention. In FIG. 1, the vertical axis indicates the common logarithm log $G_L$ of the storage elastic modulus or the common logarithm log $G_N$ of the loss elastic modulus and the horizontal axis indicates the temperature. With the toner in this invention that has these characteristics, since sudden decreases of the elastic moduli are seen at the melting point in the temperature range of 50 to 120° C. and since the elastic moduli are stable within predetermined ranges, non-uniformity of image gloss due to the distribution of temperature according to image parts in the fixing process can be prevented and excessive permeation into paper or other object of transfer can be prevented even at a high temperature.

Due to the having the abovementioned arrangements, the toner in this invention is excellent in anti-toner-blocking property, image preservation, and low-temperature fixing property.

Method of Producing the Toner for Electrostatic Image Development

Though there are no restrictions in particular concerning the method of producing the toner in this invention, a wet granulation method is preferable. Favorable wet granulation methods include known methods, such as the melt suspension method, emulsion aggregation method, and dissolution suspension method. The emulsion aggregation method shall be described as an example below.

With the emulsion aggregation method, a resin particle dispersion, a colorant dispersion, and, where necessary, a release agent dispersion and dispersions of other components are prepared (this process may be referred to hereinafter as the "emulsification process"). The method also includes a process (which may be referred to hereinafter as the "aggregation process"), in which the resin particle dispersion, which is prepared by dispersing at least resin particles, the colorant dispersion, which is prepared by dispersing a colorant, and where necessary, the release agent dispersion, which is prepared by dispersing a release agent, and the other dispersions, which are prepared by dispersing the other components, are mixed together and the resin particles and the colorant are aggregated to form aggregated particles and thereby prepare an aggregated particle dispersion, and a process (which may be referred to hereinafter as the "coalescing process"), in which the aggregated particles are heated and coalesced to form toner particles.

In the case where a polyester resin is used as the crystalline resin, the emulsion particles (droplets) of the polyester resin are formed in the above-mentioned emulsification process by applying a shear force to a solution prepared by mixing an aqueous medium and a mixed solution (polymer solution), which contains the polyester resin that has been sulfonated etc., and, where necessary, the colorant.

By heating or dissolving the polyester resin in an organic solvent in this process, the viscosity of the polymer solution may be lowered to form emulsion particles. A dispersant may also be used to stabilize the emulsion particles or increase the viscosity of the aqueous medium.

Examples of the dispersant include water-soluble polymers, such as polyvinyl alcohol, methyl cellulose, carboxymethyl cellulose, and sodium polyacrylate; surfactants, including anionic surfactants, such as sodium dodecylbenzene sulfonate, sodium octadecyl sulfate, sodium oleate, sodium laurate, and potassium stearate; cationic surfactants, such as laurylamine acetate, and lauryltrimethylammonium chloride; ampholytic surfactants, such as lauryldimethylamine oxide; and nonionic surfactants, such as polyoxyethylene alkyl ether, polyoxyethylene alkylphenyl ether, and polyoxyethylene alkylamine; and inorganic compounds, such as tricalcium phosphate, aluminum hydroxide, calcium sulfate, calcium carbonate, and barium carbonate.

In the case where an inorganic compound is to be used as the above-mentioned dispersant, though a commercially available compound may be used as it is, a method of producing fine particles of the inorganic compound in the dispersant for the purpose of obtaining fine particles may be employed as well.

The usage amount of the dispersant is preferably 0.01 to 20 mass parts per 100 mass parts of the polyester resin (binder resin).

In the abovementioned emulsification process, if the polyester resin is copolymerized with a dicarboxylic acid with a sulfonic acid group (if a suitable amount of dicarboxylic-acid-derived component with sulfonic acid group is contained in the acid-derived component), the emulsion particles can be formed using a reduced amount of surfactant or other dispersion stabilizer or without using any surfactant or other dispersion stabilizer at all.

Examples of the abovementioned organic solvent include ethyl acetate and toluene and these are suitably selected and used according to the polyester resin.

The usage amount of the organic solvent is preferably 50 to 5000 mass parts and more preferably 120 to 1000 mass parts per a total of 100 mass parts of the polyester resin and other monomers used as necessary (may be referred to hereinafter collectively and simply as "polymer"). The colorant may be mixed in prior to forming the emulsion particles. The colorant used is as has been described above in the section on the "colorant" of the toner in this invention.

Examples of the dispersion medium of the abovementioned resin particle dispersion, the colorant dispersion, the release agent dispersion, and the dispersions of other components include aqueous media, etc. Examples of such aqueous media include water, such as distilled water, and ion-exchanged water, and alcohol, etc. One type of such a medium may be used solitarily or two or more types may be used in combination.

Examples of emulsifiers to be used for forming the abovementioned emulsion particles include homogenizers, homomixers, pressure kneaders, extruders, media dispersers, etc. With regard to the size of the emulsion particles (droplets) of the polyester resin, the average particle diameter (volume-average particle diameter) is preferably 0.01 to 1 $\mu$m and more preferably 0.03 to 0.4 $\mu$m.

As the method of dispersing the abovementioned colorant, an arbitrary method, that is, a generally-used method, such as the use of a rotation shear type homogenizer, the use of a ball mill, sand mill, or die mill with media, etc., may be employed. Furthermore, a surfactant may be used as necessary to prepare an aqueous dispersion of the colorant or an organic solvent dispersion of the colorant may be prepared using a dispersant. The same types of dispersants used for dispersing the polyester resin may be used as the surfactant or dispersant for dispersion.

In the case where the colorant is to be mixed in the emulsification process, the mixing of the abovementioned polymer and colorant is carried out by mixing the colorant or organic solvent dispersion of the colorant in an organic solvent dispersion of the polymer.

The colorant may also be mixed in the resin prior to forming the emulsion particles. Fused dispersion, using a disperser, etc., may be used as the method of mixing the colorant in the resin.

In view of the dispersion stabilization of the resin particle dispersion, the colorant dispersion, and the release agent dispersion, the resin particle dispersion may be used as it is. However, a small amount of surfactant may be used since the colorant dispersion and the release agent dispersion are difficult to disperse as they are and in order to realize stability over time of the resin particle dispersion.

Examples of the surfactant include anionic surfactants, such as sulfuric acid ester salt surfactants, sulfonic acid salt surfactants, phosphoric acid ester surfactants, and soaps; cationic surfactants, such as amine salt type surfactants, and quaternary ammonium salt type surfactants; and nonionic surfactants, such as polyethylene glycol surfactants, alkylphenolethylene oxide adduct surfactants, and polyvalent alcohol surfactants. Among these, ionic surfactants are preferable and anionic surfactants and cationic surfactants are more preferable.

For the toner used in this invention, whereas an anionic surfactant is generally strong in dispersion force and thus excellent for the dispersion of the resin particles and the colorant, a cationic surfactant is advantageous as a surfactant for dispersing the release agent.

A nonionic surfactant is preferably used in combination with an anionic surfactant or cationic surfactant. One type of the surfactants may be used solitarily or two or more types may be used in combination.

Specific examples of the anionic surfactants include fatty acid soaps, such as potassium laurate, sodium oleate, and sodium ricinoleate; sulfate esters, such as octyl sulfate, lauryl sulfate, lauryl ether sulfate, and nonyl phenyl ether sulfate; sodium alkylnaphthalene sulfonates, such as lauryl sulfonate, dodecylbenzene sulfonate, triisopropylnaphthalene sulfonate, and dibutylnaphthalene sulfonate; sulfonic acid salts, such as naphthalenesulfonate formalin condensate, monooctylsulfosuccinate, dioctylsulfosuccinate, lauric acid amidosulfonate, and oleic acid amidosulfonate; phosphate esters, such as lauryl phosphate, isopropyl phosphate, and nonylphenyl ether phosphate; dialkylsulfosuccinic acid salts, such as sodium dioctylsulfosuccinate; and sulfosuccinic acid salts, such as disodium lauryl sulfosuccinate.

Specific examples of the abovementioned cationic surfactants include amine salts, such as laurylamine hydrochloride, stearylamine hydrochloride, oleylamine acetate, stearylamine acetate, and stearylaminopropylamine acetate, and quaternary ammonium salts, such as lauryl trimethyl ammonium chloride, dilauryl dimethyl ammonium chloride, distearyl ammonium chloride, distearyl dimethyl ammonium chloride, lauryl dihydroxyethylmethyl ammonium chloride, oleyl bis-polyoxyethylene methyl ammonium chloride, lauroyl aminopropyl dimethylethyl ammonium ethosulfate, lauroyl aminopropyl dimethylhydroxyethyl ammonium perchlorate, alkylbenzene dimethyl ammonium chloride, and alkyl trimethyl ammonium chloride.

Specific examples of the abovementioned nonionic surfactants include alkyl ethers, such as polyoxyethylene octyl ether, polyoxyethylene lauryl ether, polyoxyethylene stearyl ether, polyoxyethylene oleyl ether; alkyl phenyl ethers, such as polyoxyethylene octylphenyl ether, and polyoxyethylene nonylphenyl ether; alkyl esters, such as polyoxyethylene laurate, polyoxyethylene stearate, and polyoxyethylene oleate; alkyl amines, such as polyoxyethylene lauryl amino ether, polyoxyethylene stearyl amino ether, polyoxyethylene oleyl amino ether, polyoxyethylene soy bean amino ether, and polyoxyethylene beef tallow amino ether; alkyl amides, such as polyoxyethylene lauramide, polyoxyethylene stearamide, and polyoxyethylene oleamide; vegetable oil ethers, such as polyoxyethylene castor oil ether, and polyoxyethylene rape oil ether; alkanol amides, such as lauric acid diethanolamide, stearic acid diethanolamide, and oleic acid diethanolamide; and sorbitan ester ethers, such as polyoxyethylene sorbitan monolaurate, polyoxyethylene sorbitan monopalmeate, polyoxyethylene sorbitan monostearate, and polyoxyethylene sorbitan monooleate.

The content of an abovementioned surfactant in each dispersion may be such that this invention will not be impaired, is generally a small amount, and, specifically in the case of the resin particle dispersion, is approximately 0.01 to 1 mass %, preferably 0.02 to 0.5 mass %, and more preferably approximately 0.1 to 0.2 mass %, When the content is less than 0.01 mass %, aggregation may occur, especially when the pH of the resin particle dispersion is not adequately basic.

Also, in the case of the colorant dispersion or the release agent dispersion, the content of the surfactant is approximately 0.01 to 10 mass %, more preferably 0.1 to 5 mass %, and more preferably approximately 0.5 to 2 mass %. A content of less than 0.01 mass % is not preferable since the respective particles differ in stability in the aggregation process and problems, such as separation of specific particles, may thus occur. A content in the excess of 10 mass % is not preferable since the particle size distribution of the particles becomes broad, the control of the particle size becomes difficult, etc.

In the abovementioned aggregation process, the resin particles in the resin particle dispersion, the colorant dispersion, and, where necessary, the release agent dispersion, which have been mixed together, aggregate to form aggregate particles. In this process, it is preferable to form aggregates by heating to and aggregating at a temperature that is near the melting point of the resin in the resin particle dispersion and is less than or equal to the melting point of the resin.

The aggregates of emulsion particles are formed by making the pH of the emulsion acidic while stirring. As the pH, 2 to 6 is preferable and 2.5 to 5 is more preferable.

The aggregate particles are formed by heteroaggregation, etc., and are formed by adding an ionic surfactant, which differs from the aggregate particles in polarity, or a metal salt or other compound with a univalent charge or greater for the purpose of stabilizing the aggregate particles and controlling the particle size and particle size distribution.

In the aggregation process, a flocculant may be added as a method of stabilizing and speeding up the aggregation of particles or obtaining aggregate particles with a narrower particle size distribution.

The use of a compound with a univalent or greater charge as the flocculent is preferable, and specific examples of compound with a univalent charge or greater that can be used as flocculants include aqueous surfactants, such as the ionic surfactants and nonionic surfactants, acids, such as hydrochloric acid, sulfuric acid, nitric acid, acetic acid, and oxalic acid, metal salts of inorganic acids, such as magnesium chloride, sodium chloride, aluminum sulfate, calcium sulfate, ammonium sulfate, aluminum nitrate, silver nitrate, copper sulfate, and sodium carbonate, metal salts of fatty acids and aromatic acids, such as sodium acetate, potassium formate, sodium oxalate, sodium phthalate, and potassium salicylate, metal salts of phenols, such as sodium phenolate, metal salts of amino acids, and inorganic acid salts of aliphatic and aromatic amines, such as triethanolamine hydrochloride, and aniline hydrochloride.

In consideration of the stability of the aggregate particles, stability of the flocculant with respect to heat and time, and removal in the washing process, a metal salt of an inorganic acid is preferable in terms of performance and use.

Though the added amount of such a flocculant depends on the charge valence, it is small in all cases, and is approximately 3 mass % or less in the case of a univalent flocculant, approximately 1 mass % or less in the case of a bivalent flocculent, and approximately 0.5 mass % or less in the case of a trivalent flocculant. Since the smaller the amount of the flocculant, the more preferable, a compound of higher valence is preferable.

In the abovementioned Coalescence Process, the resin in the aggregate particles melts under a temperature higher than or equal to the melting point. In this Coalescence Process, the resin in the aggregate particles melts and fuses and toner particles for electrostatic image development are thereby formed.

In the Coalescence Process, the pH of the aggregate suspension is adjusted to be in the range of 3 to 7 under stirring in the same manner as in the aggregation process to stop the progress of aggregation, and heating is then performed at a temperature higher than or equal to the melting point of the resin to fuse the aggregates. With regard to the heating temperature, there will be no problems as long it is higher than or equal to the melting point of the resin. It is sufficient for the duration of heating to be such that fusion will be achieved sufficiently and it is thus sufficient to heat for approximately 0.5 to 10 hours.

The particles that have been coalesced in the coalescence process exist in the form of a colored particle dispersion in an aqueous medium and can be put in the form of toner particles via filtration or other solid-liquid separation process and, where necessary, a washing process and a drying process. Here, the particles are preferably washed adequately in a washing process in order to secure adequate charging characteristics and reliability with the toner.

In the abovementioned washing process, water, which has been made acidic or, depending on the case, basic, is added at an amount of several times the amount of the colored particles, and after stirring, filtration is performed to obtain the solids. Pure water of an amount of several times the amount of solids is then added to the solids and after stirring, filtration is performed. This is repeated several times and then repeated until the pH of the filtrate after filtration becomes approximately 7 to obtain the colored particles.

In the Coalescence Process, the resin may be made to undergo a crosslinking reaction while being heated to or above the melting point or after completion of coalescence. In the case where a crosslinking reaction is to be carried out, an unsaturated, sulfonated, crystalline polyester resin, which has been copolymerized with a double-bond component, is used as the binder resin, and a crosslinked structure is introduced into this resin by causing a radical reaction to occur using a polymerization initiator such as t-butyl peroxy-2-ethylhexanoate.

Examples of polymerization initiators include t-butyl peroxy-2-ethylhexanoate, cumyl perpivalate, t-butyl peroxylaurate, benzoyl peroxide, lauroyl peroxide, octanoyl peroxide, di-t-butyl peroxide, t-butyl cumyl peroxide, dicumyl peroxide, 2,2'-azobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl) cyclohexane, 2,2-bis(t-butylperoxy)octane, n-butyl 4,4-bis (t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy) hexane, di-t-butyl peroxyisophthalate, 2,2-bis(4,4-di-t-butyl peroxycyclohexyl)propane, di-t-butyl peroxy-a-methylsuccinate, di-t-butyl peroxydimethylglutarate, di-t-butyl peroxyhexahydroterephthalate, di-t-butyl peroxyazelate, 2,5-dimethyl-2,5-di(t-butylperoxy)hexane, diethylene glycol-bis(t-butylperoxycarbonate), di-t-butyl peroxytrimethyladipate, tris(t-butylperoxy)triazine, vinyl tris(t-butylperoxy)silane, 2,2'-azobis(2-methylpropioneamidinedihydrochloride), 2,2'-azobis[N-(2-carboxyethyl)-2-methylpropioneamidine], 4,4-azobis(4-cyanovaleric acid), etc.

Such a polymerization initiator may be mixed with the polymer prior to the emulsification process or may be incorporated in the aggregates in the aggregation process. A polymerization initiator may also be introduced in the coalescence process or after the coalescence process. In the case where a polymerization initiator is to be introduced in the coalescence process or after the coalescence process, a solution with which the polymerization initiator is dissolved in an organic solvent is added to the particle dispersion (resin particle dispersion, etc.). A known crosslinking agent, change transfer agent, polymerization inhibitor, etc., may be added to an abovementioned polymerization initiator for the purpose of controlling the degree of polymerization.

Though in the abovementioned emulsion aggregation method, a resin is prepared by emulsion polymerization, subject to heteroaggregation with dispersions of the colorant, release agent, etc., and then subject to fusion at a temperature higher than or equal to the melting point to obtain the toner, there will be no problems if, for example, colored resin particles or release agent encapsulated resin particles, etc., which have been obtained by seed polymerization, etc., using the colorant or release agent as a nucleus, are subject to heteroaggregation and coalescence.

There are no restrictions in particular regarding the surface area of the toner used in this invention, and a surface area within a range applicable to ordinary toners may be applied. With regard to specific values of toner surface area as measured by the BET method, approximately 0.5 to 10 $m^2/g$ is preferable, approximately 1.0 to 7 $m^2/g$ is more preferable, and approximately 1.2 to 5 $m^2/g$ is even more preferable.

With the method of producing the toner by the abovementioned emulsion aggregation method, the particle shape of the toner can be controlled. A spherical shape is preferable as the particle shape of the toner. By making the toner particles spherical, non-electrostatic attachment forces are reduced, thereby enabling improvement of the efficiency of transfer as well as improvement of powder fluidity.

With the toner in this invention, the toner particle surface may be treated by addition of an external additive, such as a fluidizing agent or aid. Known fine particles, including silica fine particles, titanium oxide fine particles, alumina fine particles, cerium oxide fine particles, carbon black, and other inorganic fine particles, the surface of which has been treated and made hydrophobic, and polymer fine particles of polycarbonate, polymethyl methacrylate, silicone resin, etc., may be used as external additives. These inorganic fine particles and resin fine particles function as fluidizing aids, cleaning aids, and other forms of external additive. The added amount of external additive with respect to 100 mass parts of toner is preferably 0.1 to 5 mass parts and more preferably 0.5 to 3 mass parts.

The surface of the toner in this invention may be covered by a surface layer. This surface layer preferably does not greatly affect the overall mechanical characteristics and melt viscoelasticity characteristics of the toner. For example, if a non-melting or a high-melting-point surface layer covers the toner thickly, the low-temperature fixing property, resulting from the use of a crystalline polyester resin, cannot be exhibited sufficiently.

The film thickness of the surface layer is thus preferably thin and, to be more specific, is preferably within the range of 0.001 to 0.5 $\mu$m.

For forming a thin surface layer of a thickness within the above range, a method of chemically treating the surface of the particles, which contain the binder resin and colorant as well as the inorganic particles and other materials that are added as necessary, can be used favorably.

Examples of the component that makes up the surface layer include silane coupling agents, isocyanates, vinyl monomer, etc., and this component preferably has a polar group introduced, and by being chemically bonded, increases the adhesive force between the toner and the paper or other transfer member onto which the toner is transferred.

The polar group may be any polarizable functional group, and examples include the carboxyl group, carbonyl group, epoxy group, ether group, hydroxyl group, amino group, imino group, cyano group, amido group, imide group, ester group, sulfone group, etc.

Methods of chemical treatment include methods of oxidizing by use of a peroxide or other strongly oxidizing substance, ozone oxidation, plasma oxidation, etc., methods of bonding a polymerizable monomer, containing a polar group, by means of graft polymerization, etc. By chemical treatment, a polar group becomes strongly bonded by a covalent bond to the molecular chain of the crystalline resin.

With the present invention, a substance with a charging property may be attached chemically or physically to the toner particle surface. Also, fine particles of metal, metal oxide, metal salt, ceramic, resin, carbon black, etc., may be added externally for the purpose of improving the charging property, conductive property, powder fluidity, lubrication property, etc.

It is preferable to use at least two or more types of such external additives and the average primary particle diameter of at least one type of the external additive used is preferably 30 nm to 200 nm and more preferably 30 nm to 150 nm.

When the average primary particle diameter is less than 30 nm, the non-electrostatic attachment forces with respect to the photoconductor increases, leading to failure of transfer and missing image parts, called hollow characters, and causing non-uniformity of transfer of overlapped images, etc. Thus although the initial toner fluidity is good in this case, since the non-electrostatic attachment forces between the toner and the photoconductor cannot be reduced adequately, the efficiency of transfer falls, thereby causing missing image parts and deterioration of the uniformity of the image. Also, due to the stress that is applied with time inside a developing machine, the fine particles become embedded into the toner surface, thereby changing the charging property and causing such problems as lowering of the copy density, overlapping onto background parts, etc. Also, when the average primary particle diameter is greater than 200 nm, the particles tends to separate readily from the toner surface and the fluidity may also become poor.

The absolute value of charge of the toner in this invention is preferably 10 to 40 $\mu$C/g and more preferably 15 to 35

$\mu$C/g. When this charge amount is less than 10 $\mu$C/g, the soiling of the background parts tends to occur readily, and when the charge amount exceeds 40 $\mu$C/g, the lowering of the image density occurs. Also, the ratio of the charge amount in summer to the charge amount in winter of the toner is preferably 0.5 to 1.5 and more preferably 0.7 to 1.3. When this ratio is outside the above preferable range, the toner be unfavorable for practical use as it will have a strong environmental dependence and will thus be poor in stability of the charging property.

B. Carrier

Though the developer in this invention may be a single-component developer, containing just the toner, or a two-component developer, containing the toner and a carrier, a two-component developer, which is excellent in charge maintaining property and stability, is preferable. The carrier is preferably a carrier that is coated with a resin and is more preferably a carrier that is coated with a nitrogen-containing resin.

Examples of the nitrogen-containing resin include acrylic resins that contain dimethylaminoethyl methacrylate, dimethyl acrylamide, acrylonitrile, etc., amino resins that contain urea, urethane, melamine, guanamine, aniline, etc.; amide resins, and urethane resins. A copolymer resin of the above may also be used.

As the carrier coating resin, two or more types of resin selected from among the abovementioned nitrogen-containing resins may be combined and used. Also, an abovementioned nitrogen-containing resin may be combined and used with a resin that does not contain nitrogen. Furthermore, an abovementioned nitrogen-containing resin may be made fine particulate and used upon dispersing in a resin that does not contain nitrogen. In particular, urea resins, urethane resins, melamine resins, and amide resins are favorable in that they are high in negative charging property and high in resin hardness and can thus restrain the lowering of the charge amount due to peeling off of the coating resin.

In general, the carrier preferably has a suitable electrical resistance value, and to be more specific, has an electrical resistance value of approximately $10^9$ to $10^{14}$ $\Omega$cm. When the electrical resistance value is a low value of $10^{16}$ $\Omega$cm as for example in the case of an iron powder carrier, the carrier can become attached to the image parts of the photoconductor (latent image holding member) due to charge injection from the sleeve and cause the latent image charges to escape via the carrier, thus leading to such problems as disturbance of the latent image, missing image parts, etc. Meanwhile, if an insulating resin covers the carrier thickly, the electrical resistance value can become too high and since the carrier charges will therefore not leak readily, the so-called edge effect problem may occur with which, even though the image has sharp edges, the image density at the central part becomes extremely thin in the case of a large-area image surface. It is therefore preferable to disperse a conductive fine powder in the resin coating layer for adjustment of the resistance of the carrier.

Specific examples of the conductive fine powder include that of a metal, such as gold, silver, or copper; carbon black; a semiconductive oxide, such as titanium oxide or zinc oxide, and a fine powder with which the surface of a powder of titanium oxide, zinc oxide, barium sulfate, aluminum borate, potassium titanate, etc., is covered with tin oxide, carbon black, metal, etc. Among the above, carbon black is preferable in terms of production stability, cost, and good conductive property.

Examples of methods of forming the resin coating layer on the surface of a carrier core material include the immersion method, in which a powder of the carrier core material is immersed in a coating layer forming solution, the spray method, in which a coating layer forming solution is sprayed onto the surface of the carrier core material, the fluidized bed method, in which a coating layer forming solution is sprayed with the carrier core material being suspended by fluid air, the kneader-coater method, in which the carrier core material and a coating layer forming solution are mixed in a kneader-coater and then removed of the solvent, and the powder coating method, in which a coating resin, which has been made fine particulate at or above the melting point of the coating resin, and the carrier core material are mixed in a kneader-coater and then cooled to perform coating. The kneader-coater method or the powder coating method is used especially favorably.

The average film thickness of the resin coating layer that is formed by an abovementioned method is normally in the range of 0.1 to 10 $\mu$m and preferably in the range of 0.2 to 5 $\mu$m.

The core material (carrier core material) to be used in the electrostatic latent image developing carrier in this invention is not restricted in particular, and examples include magnetic metals, such as iron, steel, nickel, and cobalt, magnetic oxides, such as ferrite, and magnetite, glass beads, etc. However, from the standpoint of using a magnetic brush method, a magnetic carrier is preferable. In general, the average particle diameter of the carrier core material is preferably 10 to 100 $\mu$m and more preferably 20 to 80 $\mu$m.

In producing the carrier, a heated type kneader, a heated type Henschel mixer, a UM mixer, etc., may be used, and depending on the amount of the coating resin, a heated type fluidized rolling bed or a heated type kiln, etc., may be used.

There are no restrictions in particular regarding the mixing ratio of the toner used in this invention and the carrier in the abovementioned two-component developer, and this mixing ratio may be selected in accordance to the purpose. Generally with regard to the mixing ratio (weight ratio) of the toner and the carrier, it is preferable for the toner: carrier ratio to be in the range of approximately 1:100 to 30:100 and more preferably in the range of approximately 3:100 to 20:100.

Fixing Process

The fixing process in this invention is a process wherein a heating member, which is in contact with a toner image is heated to melt the toner and fix the toner image on the recording medium, and the heating member is a member with which the surface or the vicinity of the surface that is in contact with the toner image generates heat. Of the parts of the heating member, the part that is not in contact with the toner image has a structure that prevents, by means of air or other insulating layer, the escaping of the heat generated from the surface or the vicinity of the surface of the heating member, and as a result, increases the thermal efficiency of the fixing process.

Here, that the "surface or the vicinity of the surface generates heat" signifies that the surface of the heating member that is in contact with the toner image or a position that is quite shallow in the depth direction from the surface generates heat directly, and this excludes an arrangement, where as in a prior-art heating roll, a heat generating member that is provided at the center of a heating roll generates heat and the surface of the heating roll is heated by the resulting radiant heat. Also, even if the surface does not generate heat, if an arrangement is such that the vicinity of the surface generates heat and the surface is practically heated by this heat generation, it is included among arrangements with which the "surface or the vicinity of the surface generates heat."

For the case where the "surface or the vicinity of the surface generates heat," there are no particular restrictions concerning the upper limit in the depth direction, and it is sufficient for the vicinity of the surface to generate heat in practical terms. That is, with a heating member with a multilayer arrangement, even a layer that is positioned away from the surface that is in contact with the toner image will be included in the concept of the vicinity of the surface. In the case of a heating member that is thin as a whole (approximately 3 mm or less or preferably approximately 1 mm or less), even the surface that is at the side opposite the surface that contacts the toner image will be included in the concept of the vicinity of the surface.

Specific cases include (1) the case where the heating member is a thin film and generates heat on its own, (2) the case where a heat generating layer is provided on the surface of a base and this heat generating layer generates heat, (3) the case where, in an arrangement in which a heat generating layer is provided on the surface of a base and a release layer or other layer is furthermore provided, the heat generating layer generates heat, (4) the case where an arrangement of an adhesive layer, an intermediate layer, an elastic layer, an insulating layer, etc., is included in the above-mentioned arrangement, etc.

Though the thickness of the heating layer cannot be defined unconditionally as the specifically required value will differ according to the form of heat generation, material of the heat generating layer, the amount of generated heat desired, etc., it is generally approximately 3 mm or less and preferably approximately 1 mm or less.

According to the present invention, two modes of the image forming method are provided. In the first mode of the image forming method, the heating member takes on the form of a roller and has disposed at the surface or vicinity of the surface, a resistive heat generator layer, which generates heat upon passage of electricity, and the surface or the vicinity of the surface of the heating member is made to generate heat by the passage of electricity through the resistive heat generator layer.

In the second mode of the image forming method, the surface or vicinity of the surface of the heating member is made of a conductive member and a magnetic field is made to act on the conductive member to make the surface or the vicinity of the surface of the heating member generate heat by means of the resulting eddy current.

The respective modes shall now be described.

First Mode

In describing the first mode, a preferred embodiment (first embodiment) of this invention using the heating member of the first mode shall be described.

Figure 2:
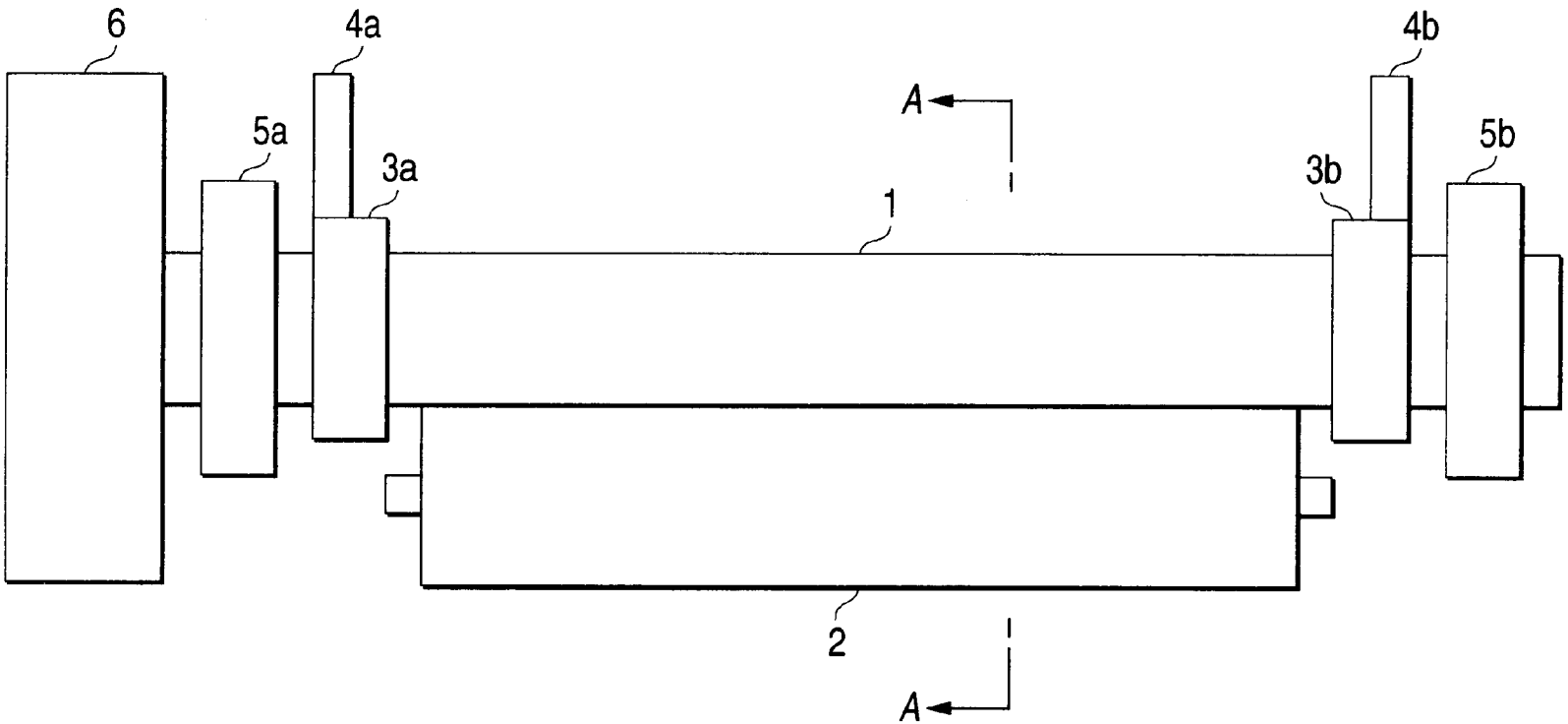
FIG. 2 is a schematic view of a first embodiment of the present invention, namely, a heat-fixing device that includes a heating member of a first mode.
Figure 3:
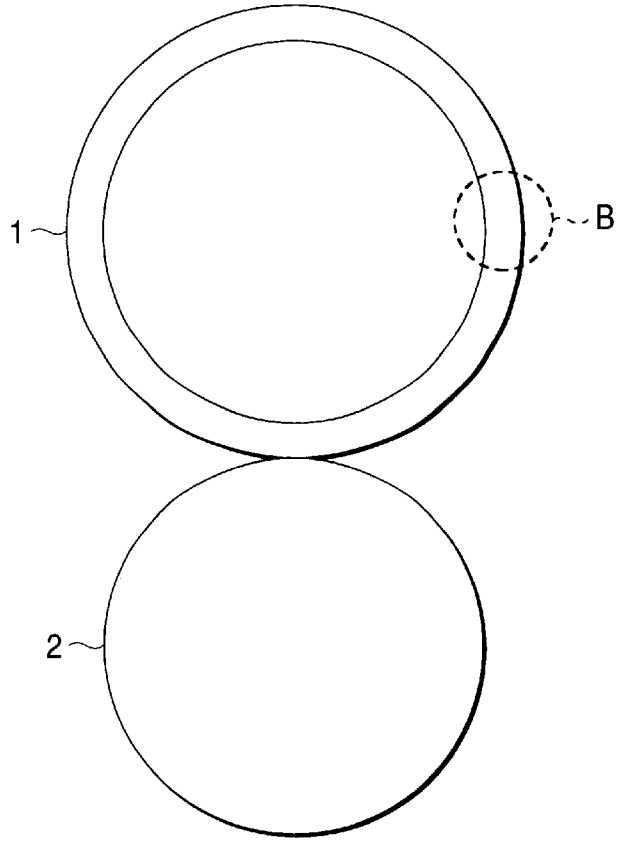
FIG. 3 is a sectional view along line A—A of FIG. 2.
Figure 4:
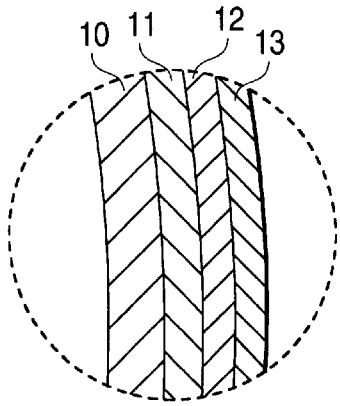
FIG. 4 is an enlarged sectional view of the heating roll, with which the area of circle A in FIG. 3 has been enlarged.

FIG. 2 is a schematic view of a heat-fixing device in this invention, which includes a heating member of the first mode. FIG. 3 is a sectional view along line A—A of FIG. 2 and FIG. 4 is an enlarged sectional view of the heating roll, with which the area of circle A in FIG. 3 has been enlarged.

In these drawings, 1 is a heating roll, 2 is a pressure roll, 3*a* and 3*b* are ring-shaped electrodes, each made of a conductor, 4*a* and 4*b* are feeder brushes, 5*a* and 5*b* are bearings, 6 is a driving gear, 10 is the base of the heating roll, 11 is an insulator layer, 12 is a resistive heat generator layer, and 13 is a release layer.

The feeder brushes 4*a* and 4*b* are connected to an external power supply, and by contacting ring-shaped electrodes 3*a* and 3*b*, cause an electric current to flow through resistive heat generator layer 12, thereby causing resistive heat generator layer 12 to generate heat and heat the surface of heating roll 1.

The heating roll 1 that has been heated to a predetermined temperature is rotated by driving gear 6 with a nip part being formed between pressure roll 2, which rotates while pressing against heating roll 1.

A recording medium on which an unfixed toner image formed from the toner in this invention is formed, is inserted through the nip part so that the surface on which the toner image is formed contacts the surface of heating roll 1 to fix the toner image on the recording medium surface.

Since the heating roll 1 of this embodiment has an arrangement where heating is performed not by the radiation of a halogen lamp, etc., but by directly applying a current from the exterior to the resistive heat generator layer 12 disposed in the vicinity of the surface of heating roll 1, the heat generating efficiency is high and thus not only can the warming-up time be shortened, but the advantage that the temperature does not drop readily from the set temperature is provided even in the case where paper or other recording medium takes up the heat from the surface of heating roll 1 in the process of passing through the fixing device or even in the case where a recording medium that has absorbed moisture under high-temperature, high-humidity conditions is used.

In this embodiment, though a resistive heat generator layer is not disposed at pressure roll 2, pressure roll 2 may be provided with the same arrangement as heating roll 1 if necessary.

There are no restrictions in particular with regard to base 10 as long as it can withstand the fixing temperature and the pressing conditions. In general, a metal, such as aluminum, and copper, is feasible from the standpoint of cost, strength, ease of processing, etc., and surface treatment, etc., may be applied as necessary.

The insulator layer 11 maintains electrical insulation between base 10 and resistive heat generator layer 12 to increase the heat generating efficiency of resistive heat generator layer 12 and is preferably made of a material with a specific volume resistivity of $10^{10}\Omega\cdot$cm or more.

Specific examples of materials that make up insulator layer 11 include oils, such as insulating mineral oil, castor oil, soy oil, linseed oil, perilla oil, tung oil, sardine oil, synthetic dry oil, synthetic insulating oil, and silicone oil; insulating coatings, such as insulating varnish, ceramic varnish, bakelite varnish, nitrocellulose lacquer, acetyl cellulose lacquer, ethyl cellulose lacquer, and silicone varnish; bitumen, such as natural asphalt, synthetic asphalt, paraffin, ceresin, and petrolactum; waxes, such as carnauba wax, montan wax, beeswax, ketone wax, and artificial wax; natural rubbers, such as raw rubber, vulcanized rubber, and hard rubber; rubber derivatives, such as chlorinated rubber, hydrochlorinated rubber, and cyclized rubber; synthetic rubbers, such as gutta-percha, balata, butadiene rubber, acrylonitrile rubber, chloroprene rubber, isobutylene rubber, polysulfide rubber, and silicone rubber; natural resins, such as shellac, copal, rosin, amber, and amberoid; synthetic resins, such as phenol resin, furfural resin, urea resin, melamine resin, aniline resin, casein resin, silicon resin, alkyd resin, epoxy resin, polysulfide epoxy resin, aryl resin, polyester resin, polyamide resin, polyimide resin, styrene resin, vinylcarbazole resin, isobutylene resin, vinyl chloride resin, vinyl chloride vinyl acetate resin, vinylidene chloride resin, vinyl alcohol resin, vinyl formal resin, vinyl butyral resin, acrylic resin, and ethylene resin; and cellulose derivatives, such as acetyl cellulose, acetyl butyl cellulose, regenerated cellulose, nitrocellulose, celluloid, ethyl cellulose, and benzyl cellulose. One type of such an insulating material may be used solitary or plural types may be used as necessary.

The specific volume resistivity of insulator layer 11 is preferably no less than $10^{10}\Omega\cdot$cm, more preferably no less than $10^{12}\Omega\cdot$cm, and even more preferably no less than $10^{14}\Omega\cdot$cm. When the specific volume resistivity is less than $10^{10}\Omega\cdot$cm, the electric current that is applied to resistive heat generator layer 12 tends to flow into base 10, causing the heat generating efficiency to be poor and electrical leakage to occur readily.

There are no particular restrictions regarding the material that makes up resistive heat generator layer 12 and the specific resistivity is preferably no less than 100 $\mu\Omega\cdot$cm (20° C.) and no more than 3000 $\mu\Omega\cdot$cm (20° C.), more preferably no less than 150 $\mu\Omega\cdot$cm (20° C.) and no more than 2500 $\mu\Omega\cdot$cm (20° C.), and even more preferably no less than 200 $\mu\Omega\cdot$cm (20° C.) and no more than 2000 $\mu\Omega\cdot$cm (20° C.).

When the specific resistivity is less than 100 $\mu\Omega\cdot$cm (20° C.), the efficiency will be poor since the amount of heat generated by passage of current will be low and thus a large amount of current will have to be supplied, and when the specific resistivity exceeds 3000 $\mu\Omega\cdot$cm, the efficiency will be poor since the voltage for supplying current must be made large due to the excessive resistance.

Specific examples of the material of resistive heat generator layer 12 include ceramics, such as aluminum nitride, silicon carbide, and aluminum oxide, and alloys, such as silver palladium.

With regard to the material of release layer 13, the angle of contact with water at 25° C. is preferably 80° or more, more preferably 85° or more, and even more preferably 90° or more from the standpoint of preventing the offset that occurs as a result of attachment of molten toner onto release layer 13 at the time of fixing.

Specific examples of the material of release layer 13 include styrenes, such as styrene, parachlorostyrene, and α-methylstyrene; α-methylene fatty acid monocarboxylic acids, such as methyl acrylate, ethyl acrylate, n-propyl acrylate, lauryl acrylate, 2-ethylhexyl acrylate, methyl methacrylate, methacrylic acid, n-propyl methacrylate, lauryl methacrylate and 2-ethylhexyl methacrylate; nitrogen-containing acrylics, such as dimethylaminoethyl methacrylate; vinylnitriles, such as acrylonitrile, and methacrylonitrile; vinylpyridines, such as 2-vinylpyridine, and 4-vinylpyridine; vinyl ethers, such as vinyl methyl ether, and vinyl isobutyl ether; vinyl ketones, such as vinyl methyl ketone, vinyl ethyl ketone, and vinyl isopropenyl ketone; olefins, such as ethylene, and propylene; homopolymers of vinyl fluorine-containing monomers, such as vinylidene fluoride, tetrafluoroethylene, and hexafluoroethylene, and copolymers of two of more types of such monomers; silicones, such as methyl silicone, and methyl phenyl silicone; polyesters, which contain bisphenol, glycol, etc.; epoxy resins, polyurethane resins, polyamide resins, cellulose resins, polyether resins, polycarbonate resins; etc. One type of such a resin may be used solitarily or two or more types may be used in combination.

Among the above, a homopolymer of a vinyl fluorine-containing monomer, etc., a copolymer of two or more types of vinyl fluorine-containing monomer, etc., or a silicone is especially favorable in that the angle of contact with water of the surface of heating roll 1 can be increased.

In forming release layer 13 using an abovementioned resin, the resin may be coated onto the surface of base 10 upon dissolution in a solvent, etc., or after coating a polymerizable monomer or oligomer, etc., onto the surface of base 10, the polymerizable monomer or oligomer may be polymerized by heating, etc., to form release layer 13. Also, a resin film may be formed and wound around base 10, and release layer 13 may be formed by heating or performing other form of treatment on this resin film.

With this invention, the surface of heating roll 1 preferably has a suitable arithmetic mean surface roughness (Ra), and with regard to range, the arithmetic mean roughness (Ra) according to the method of JIS B 0601 is preferably such that 0.1 $\mu$m $\leqq$Ra$\leqq$3.0 $\mu$m. By making the surface of heating roll 1 have such a suitable surface roughness, the pressure applied to the toner image can be scattered to inhibit the occurrence of staining and thereby restrain the occurrence of the non-uniformity of gloss and non-uniformity of coloration.

Though the effects of roughening the surface of the heating roll can also be obtained in a heating roll fixing device that uses an ordinary rubber layer and uses a halogen lamp, etc., for heating, since the heat transfer efficiency is poor and the heat is taken up by the recording medium in this case as has been described above, it is difficult to maintain uniformity of the temperature of the surface of the heating roll and thus the non-uniformity of gloss and non-uniformity of coloration tend to occur more readily in comparison to the image forming method of this invention.

An arithmetic mean roughness (Ra) of the surface of heating roll 1 that is less than 0.1 $\mu$m is unfavorable in that the effects may not be adequate since the unevenness of the recording medium is more likely to have an influence, and a roughness in the excess of 3.0 $\mu$m is unfavorable in that the heat applied to the toner image on the recording medium will be non-uniform and non-uniformity of gloss and non-uniformity of coloration are therefore more likely to occur.

With the fixing process in the image forming method of this invention, the surface temperature of the heating roll can be set to no less than 60° C. and no more than 150° C., and thus to a lower temperature than in the prior art. When the surface temperature of the heating roll 1 is less than 60° C., it may not be possible to provide the heat that is adequate and necessary for fixing during the time of contact of heating roll 1 and the toner image, and this is unfavorable as fixing will not occur in this case. Also, since the toner used in this invention does not exhibit the effects of improved gloss and coloration with rise in fixing temperature, a setting that exceeds 150° C. is unfavorable in terms of energy savings.

Second Mode

With regard to the second mode, the principles of making the surface or the vicinity of the surface of the abovementioned heating member generate heat by means of an eddy current that is generated by making a magnetic field act on the abovementioned conductive member (this may be referred to hereinafter as the "electromagnetic induction heating method") shall be described first.

Figure 5:
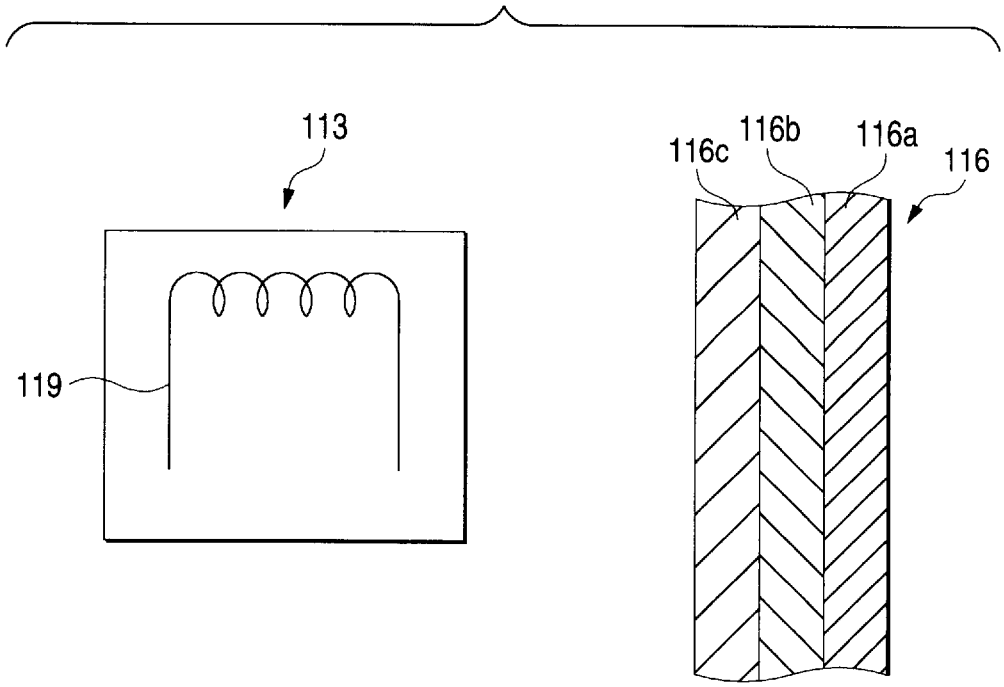
FIG. 5 is a schematic explanatory view for explaining the principles of the electromagnetic induction heating method.

FIG. 5 is a schematic explanatory view for explaining the principles of the electromagnetic induction heating method. In FIG. 5, 116 indicates the cross-section of a part of a heating member, such as a heating roll of a roll type fixing device, a heating belt of a belt-nip type fixing device, or an endless intermediate transfer belt or intermediate transfer roll used as an intermediate transfer medium in a simultaneous transfer and fixing method, and 113 indicates an electromagnetic induction heating device.

Heating member 116 is arranged by providing a heating layer 116*b*, made of a conductive member that generates heat on its own by the electromagnetic induction effect, and a release layer 116*c*, which is good in release property with respect to the toner, on the surface of a base 116*a*. Electromagnetic induction heating device 113 forms an alternating magnetic field that is substantially orthogonal to the surface of heating member 116 by application of an alternating current to an exciting coil 119 by means of an unillustrated exciting circuit.

The principles of heat generation by heat generating layer 116*b* by the electromagnetic induction effect shall now be described. When an alternating current is applied to exciting coil 119 by the exciting circuit, a magnetic flux is repeatedly generated and dissipated in the surroundings of the exciting coil. When this magnetic flux crosses the heating layer 116*b* of heating member 116, an eddy current is generated in heating layer 116*b* so as to give rise to a magnetic field that obstructs the variation of the magnetic flux. Joule heat is thus generated as a result of this eddy current and the specific resistivity of heating layer 116*b*.

Due to the skin effect, the eddy current flows in a localized manner and practically only in the electromagnetic induction heating device 113 side surface of heating layer 116*b*, and heat is generated by a power that is proportional to the skin resistance Rs of heating layer 116*b*. When the angular frequency is ω, the magnetic permeability is $\mu$, and the specific resistivity is ρ, the skin depth δ is given by the following equation:

$$\delta=(2\rho/\omega\mu)^{1/2}$$

Furthermore, the skin resistance Rs is given by the following equation.

$$Rs=\rho/\delta=(\omega\mu\rho/2)^{1/2}$$

The power P that is generated at heat generating layer 116*b* of heating member 116 is expressed by the following equation when the current that flows through heating member 116 is Ih:

$$P\,Rs\int|Ih|^2dS$$

Thus by increasing the skin resistance Rs or increasing the current Ih, the power P can be increased and thus the amount of heat generated can be increased. Here, the skin depth δ (m) is expressed as a function of the frequency f (Hz) of the exciting circuit, the relative magnetic permeability $\mu r$, and the specific resistivity ρ (Ωm) by the following equation:

$$\delta=503\ (\rho/f\mu r))^{1/2}$$

This skin depth indicates the depth of absorption of the electromagnetic wave used for electromagnetic induction and at a depth beyond this depth, the intensity of the electromagnetic wave becomes 1/e or less, that is, most of the energy is absorbed within this depth.

Here, the thickness of heat generating layer 116*b* is preferably made thicker (1 to 100 $\mu$m) than the skin depth expressed by the above equation. Also if the thickness of heat generating layer 116*b* is less than 1 $\mu$m, the efficiency will be poor since most of the electromagnetic energy will not be absorbed.

In the case where base 116*a* takes on the form of a belt, a film, for example of polyester, polyimide, aromatic polyamide, polyacrylate, polyether imide, polyether sulfone, etc., can be used as base 116*a*. In this case, though a thicker thickness will be preferable in consideration of the processability and mechanical strength, a thinner thickness will be preferable with regard to the heat capacity in consideration of the heat taken up by the recording medium. An appropriate thickness is approximately 1 to 100 $\mu$m and it is preferable for the thickness to be approximately 3 to 30 $\mu$m.

In the case where base 116*a* takes on the form of a roller, there are no restrictions in particular regarding the material of the base 116*a*, and a material of base 10 in the heating roll described in the above section on the first embodiment may be used. Also, a combination of base 10 and an insulator layer 11 in the heating roll described in the above section on the first mode may be used as well.

For the heat generating layer 116*b*, a conductive organic substance or a metal of high magnetic permeability is used. As a conductive organic substance, a conductive polymer or conductive organic fiber may be formed, etc., and selected as suited. As a conductive polymer, a polymer obtained by polymerizing pyrrole or a monomer derived therefrom, a polymer obtained by polymerizing thiophene or a monomer derived therefrom, or a polymer obtained by polymerizing using a direct plating system may be selected as suited. As a conductive organic fiber, a fiber with which a conductive organic polymer is made integral with a fiber by coating, permeation, or attachment may be selected as suited. Examples of metals of high permeability that may be selected include nickel, iron, copper, gold, silver, aluminum, steel, etc. Among the above, copper, nickel, aluminum, and iron are suitable in consideration of heat generating performance and processability and copper is especially preferable.

The release layer 116*c* is preferably a coat layer of good heat resistance and release property, and for example, fluorine resin, silicone rubber, or fluororubber may be selected. In consideration of forming property and durability, PFA (polytetrafluoroethylene—perfluoroalkyl vinyl ether copolymer) is favorable. The thickness of release layer 116*c* is preferably approximately 1 to 30 $\mu$m in consideration of long-term reliability against wear and heat capacity and a thickness of approximately 5 to 10 $\mu$m is even more preferable.

Heating member 116 is generally provided with the abovementioned layer structure, and a heat-resistant elastomer layer (elastic layer) may be equipped between heat generating layer 116*b* and release layer 116*c* or on top of release layer 116*c*. By providing a heat-resistant elastomer layer, the problem of inadequate fixing due to unevenness of the paper or other recording member can be resolved. A fluororubber or silicone rubber that is excellent in heat resistance is preferable for the heat-resistant elastomer layer. In the case where the release property of the heat-resistant elastomer layer is inadequate, the same type of release layer as the release layer 116*c* is preferably formed on top of the heat-resistant elastomer layer.

Though the electromagnetic induction heating method may obviously be applied to a fixing device of a normal electrophotography device with which transfer and fixing are carried out independently, it may also be applied to a simultaneous transfer and fixing method, wherein transfer and fixing are carried out simultaneously.

A simultaneous transfer and fixing type image forming method includes at least a toner image forming process, which has the ordinary charging, latent image forming, developing, transfer, and other processes and in which a toner image is formed on the surface of an endless belt type or roll type intermediate transfer medium using a monochromatic toner or toners of plural colors, such as magenta, yellow, cyan, and black, and a transfer and fixing process (fixing process), in which the toner image that has been formed on the surface of the intermediate transfer medium is heated and made to contact and pressed against a recording medium while the toner is melted to transfix the image onto the recording medium.

In the case where the intermediate transfer medium takes on the form of an endless belt, the intermediate transfer medium is suspended in a manner enabling revolving movement and is arranged so that the toner image is transferred at the part where the outer peripheral surface of the intermediate transfer medium opposes an image holding member (photoconductor) that is included in the toner image forming process. Normally for the transfer and fixing process, a nip part is formed by a heating roll and a pressure roll, and the intermediate transfer medium and a recording medium are pressed against each other by being inserted into the nip part in a manner such that the surface of the intermediate transfer medium on which the toner image has been formed contacts the recording medium. In addition to the combination of the heating roll and pressure roll or in place of the combination of the heating roll and pressure roll, a pair of pressing members (which may be a roller-roller pair) may be employed (such arrangements shall be referred to collectively as "press transfer and fixing members") and an arrangement may be provided for priorly heating the intermediate transfer medium before the process of performing the final transfer and fixing by means of such press transfer and fixing members.

With the present invention, the monochromatic toner or the toners of plural colors that are used here are toners in this invention, and the above-mentioned electromagnetic induction heating type heating member is used as a means for heating the toner image. The heating member may be the intermediate transfer medium or a press transfer and fixing member. With regard to the latter, in the case where transfer and fixing are to be performed by a combination of a heating roll and a pressure roll, the heating roll may be arranged to be the heating member or the pressure roll may be arranged to be the heating member.

In the case where the intermediate transfer medium is the heating member, an electromagnetic induction heating device, which forms an alternating magnetic field that is orthogonal to the surface of the intermediate transfer medium, is disposed at a position, which is in the circumferential direction of the intermediate transfer medium and is at the upstream side of the position at which the press transfer and fixing members are disposed. In the case where the toner image is to be heated at a press transfer and fixing member as well, the press transfer and fixing member may be arranged to be the heating member in the same manner as in the case where a heating device that heats the intermediate transfer medium is equipped.

After the toner image on the surface of the intermediate transfer medium has been heated in advance to melt the toner and/or the toner has been heated by means of a press transfer and fixing member to melt the toner and the softening of the toner by heating has been completed, the softened toner is pressed against the recording medium. This causes the temperature of the toner that has contacted the recording medium to drop and the toner thus becomes solidified and fixed onto the recording medium. Thus in the abovementioned simultaneous transfer and fixing method, good transfer and fixing are accomplished.

When the second mode of the image forming method is applied to a simultaneous transfer and fixing method as has been described above, it is sufficient that at least the intermediate transfer medium or press transfer and fixing member is heated. A film-like heat generating layer (conductive layer) is provided on the surface layer of the intermediate transfer medium or press transfer and fixing member and heat is accumulated in this heat generating layer. By making the heat capacity of this intermediate transfer medium or press transfer and fixing member small, the toner temperature can be made to lower inside the nip part at which the recording medium is pressed against the intermediate transfer medium to enable good transfer and fixing. By such an arrangement, reduction of the energy used in fixing, reduction of the power used during the fixing process, and reduction of the startup time of the device can be achieved at the same time.

With this heating method, the intermediate transfer medium or a press transfer and fixing member can be made to self-generate the heat generating layer heat to or above the melting point of the toner instantly and in a non-contacting manner by electromagnetic induction from the exterior by an electromagnetic induction heating device, and the toner that forms the toner image on the intermediate transfer medium is thereby heated and softened rapidly. By then inserting the toner image between the intermediate transfer medium and a pressing member, the toner on the intermediate transfer medium is cooled by the recording medium, etc., which is at room temperature, and as a result, the toner is cooled to below the melting point and the toner is thereby solidified and fixed onto the recording medium.

In the case where the second mode of the image forming method is applied to a simultaneous transfer and fixing method, since a heat generator or thin film, which is of low heat capacity and can be raised rapidly in temperature, can be used, savings in power and reduction of waiting time (quick starting) can be realized. Other advantages, such as restraining of the internal temperature rise within an image forming apparatus, etc., are also provided.

A second embodiment of the present invention, which is an embodiment applying the second mode of the image forming method to a simultaneous transfer and fixing method, shall now be described based on the drawings.

Figure 6:
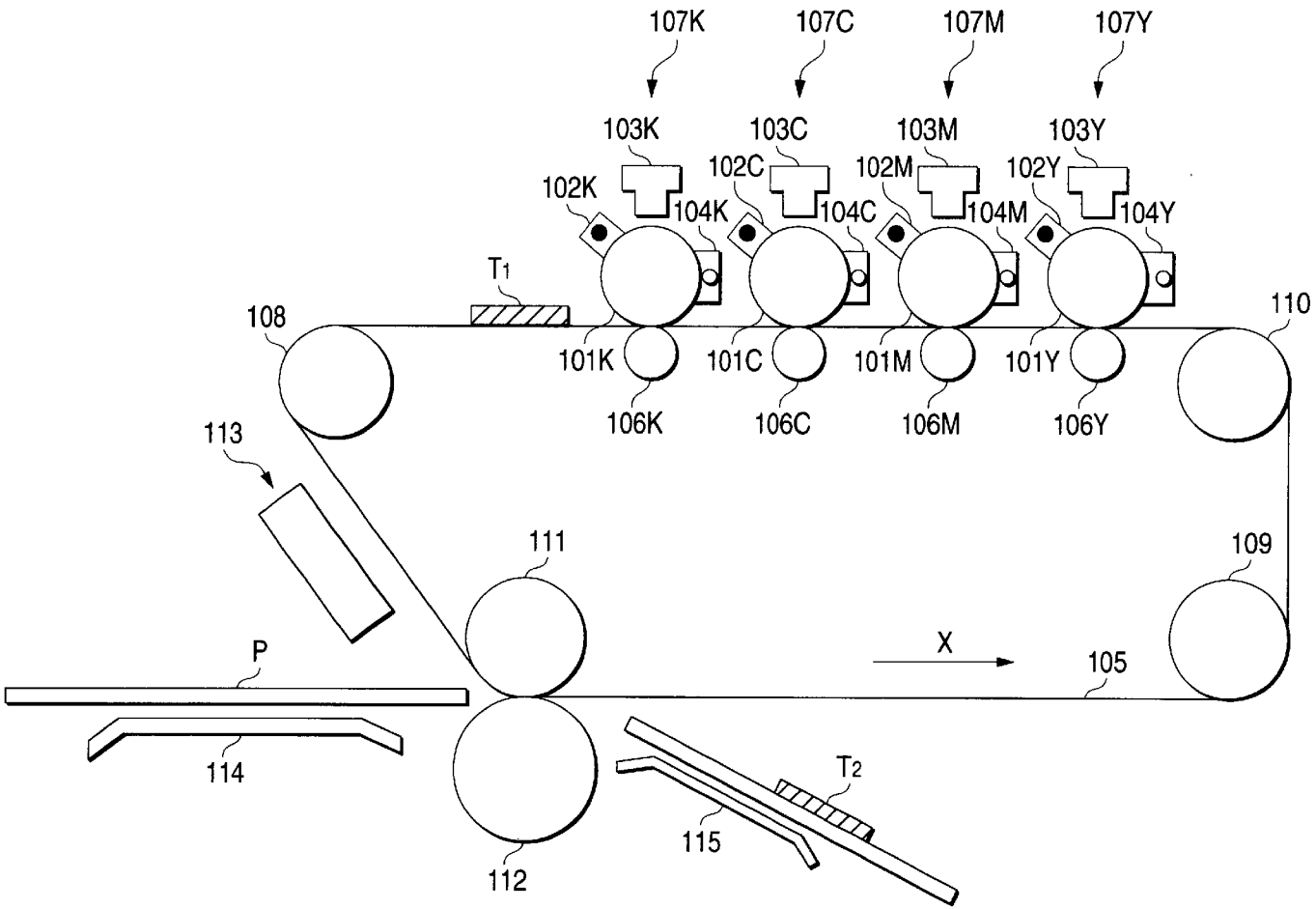
FIG. 6 is a schematic arrangement diagram that shows a second embodiment of the present invention, namely, an embodiment applying a second mode of the image forming method of this invention to a simultaneous transfer and fixing method.

FIG. 6 is a schematic arrangement diagram that shows an image forming apparatus of the second embodiment. This image forming apparatus is equipped with an endless-belt type intermediate transfer medium 105, which is tensioned and supported in a manner enabling revolving of the peripheral surface by tension rolls 108 and 109, driving roll 110, and secondary transfer roll 111. Four image forming units 107Y, 107M, 107C, and 107K, which form toner images of yellow, magenta, cyan, and black, respectively, are disposed at positions that oppose the intermediate transfer medium 105. The image forming units respectively have image holding members (photoconductors) 101Y, 101M, 101C, and 101K, on the surface of each of which an electrostatic latent image is formed, and at the surroundings of the respective image holding members 101Y, 101M, 101C, and 101K are equipped charging devices 102Y, 102M, 102C, and 102K, which charge the surfaces of image holding members 101Y, 101M, 101C, and 101K, respectively, in a substantially uniform manner, exposure devices 103Y, 103M, 103C, and 103K, which illuminate image light and form latent images on the surfaces of image holding members 101Y, 101M, 101C, and 101K, respectively, developing devices, 104Y, 104M, 104C, and 104K, which transfer toners selectively onto the latent images and form toner images, and primary transfer rolls 106Y, 106M, 106C, and 106K, which transfer the toner images obtained onto intermediate transfer medium 105.

At the most downstream part of the area in the revolving direction of intermediate transfer medium 105 that is in contact with secondary transfer roll 111 is equipped a pressure roll 112, which presses intermediate transfer medium 105 against secondary transfer roll 111, and at the upstream side of the part in the revolving direction of intermediate transfer medium 105 that is pressed against pressure roll 112 is equipped an electromagnetic induction heating device 113, which heats the toner image that has been transferred onto intermediate transfer medium 105.

Furthermore, inside this device are equipped a paper guide 114 for feeding a recording medium P to the press contacting part between pressure roll 112 and intermediate transfer medium 105 and a discharge tray 115 for conveying the recording medium to an unillustrated paper discharge part. Intermediate transfer medium 105 is made to revolve in the direction of the arrow X by the rotation of driving roll 110. Intermediate roller 105 has the layer structure of heating member 116 shown in FIG. 5.

To be more specific, with this embodiment, a polyimide member of a circumferential length of 800 mm, a width of 320 mm, and a thickness of 15 μm is used, from the standpoint of ease of manufacture and usability, as base 116*a*. Copper is used in heat generating layer 116*b*. The thickness of heat generating layer 116*b* is adjusted to a thickness of 2 μm, which is considered to be optimal. Furthermore, PFA is used in release layer 116*c*. The thickness of release layer 116*c* is adjusted to 5 μm in consideration of long-term reliability against wear and for the purpose of making the heat capacity as low as possible.

The heat capacity of intermediate transfer medium 105 is approximately 2.5 joule/° C. for an A4 size area, and this corresponds to approximately 40% of the heat capacity of the recording medium.

At the image forming units 107Y, 107M, 107C, and 107K, images are successively layered by the toners of four colors onto the peripheral surface of intermediate transfer medium 105, thereby providing an unfixed toner image $T_1$. For example in the case of image forming unit 107Y, the image holding member 101Y is charged substantially uniformly by charging device 102Y and then illuminated, by exposure device 103Y, with laser light, which has been pulse-width modulated in accordance to image signals of an original from a laser scanner. An electrostatic latent image corresponding to the image is thereby formed on image holding member 101Y. The image-like electrostatic latent image is then developed by developing device 104Y and a toner image is thereby formed on the surface of image holding member 101Y. This toner image is transferred electrostatically onto intermediate transfer medium 105 by the actions of primary transfer roll 106Y at the primary transfer part, which is the part at which image holding member 101Y contacts intermediate transfer medium 105. The unfixed toner image $T_1$ is thereby formed.

When the unfixed toner image $T_1$, which has been formed on the peripheral surface of intermediate transfer medium 105, is carried by the revolution of intermediate transfer medium 105 to the position opposing electromagnetic induction heating device 113, the heat generating layer 116*b* of intermediate transfer medium 105 is made to generate heat by the eddy current that is generated by the magnetic field from electromagnetic induction heating device 113. The unfixed toner image $T_1$, which has been formed on the peripheral surface of intermediate transfer medium 105, is thereby heated and the toner enters the molten state.

The intermediate transfer medium 105, on which is formed the unfixed toner image $T_1$ with which the toner has entered the molten state, is overlapped with a transfer medium P, which is conveyed via paper guide 114, and is inserted into the nip part formed by secondary transfer roll 111 and pressure roll 112. The heat at the surface of intermediate transfer medium 105, which is low in heat capacity, is then taken up by transfer medium P and cooled rapidly. The toner is thereby solidified and fixed onto recording medium P and a fixed image $T_2$ is thereby formed. The recording medium, onto which the toner image has been transferred and fixed, is thereafter discharged onto discharge tray 115 and the formation of a full-color image is thereby completed.

Figure 7:
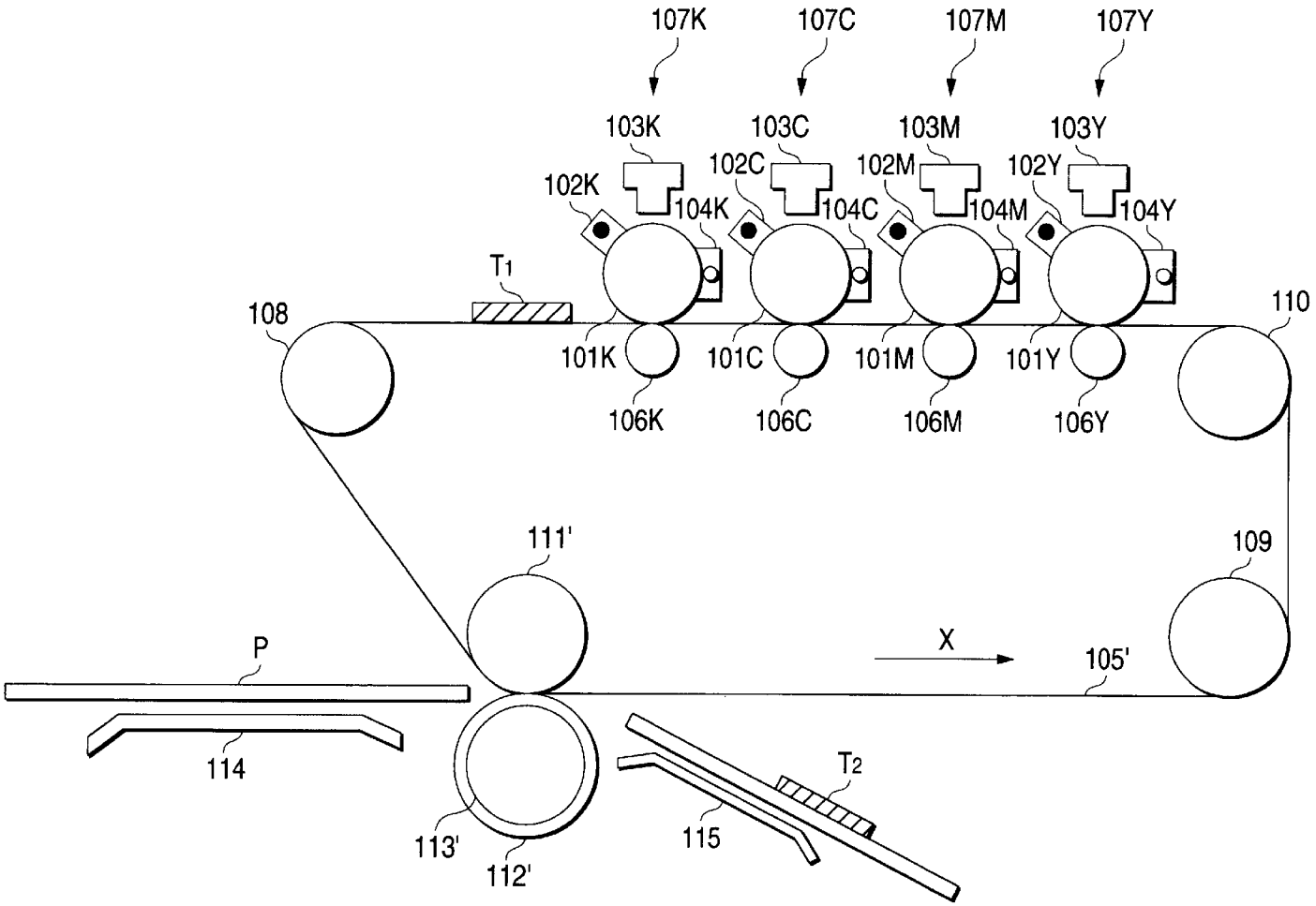
FIG. 7 is a schematic arrangement diagram that shows a third embodiment of the present invention, namely, another embodiment applying the second mode of the image forming method of this invention to a simultaneous transfer and fixing method.

FIG. 7 is a schematic arrangement diagram that shows an image forming apparatus of a third embodiment of the present invention, which is another embodiment applying the second mode of the image forming method to a simultaneous transfer and fixing method. With the image forming apparatus of this embodiment, intermediate transfer medium 105' has the arrangement of a general intermediate transfer medium and does not perform heating. Instead, secondary transfer roll 111' is provided with the layer structure of heating member 116 shown in FIG. 5, and an electromagnetic induction heating device 113', which forms an alternating magnetic field in a radiating manner, is equipped inside secondary transfer roll 111'. The third embodiment differs from the second embodiment in regard to these points.

To be more specific regarding the layer structure of secondary transfer roll 111', a cylindrical aluminum member of a length of 320 mm and a diameter of 50 mm is used as base 116*a*. A copper member of 2 μm thickness is used as heat generating layer 116*b*. Furthermore, a PFA member of 2 μm thickness is used as release layer 116*c*.

Besides the above, members having the same functions as those of the second embodiment are provided with the same symbols as those of the second embodiment and detailed descriptions thereof shall be omitted.

As with the second embodiment, an unfixed toner image $T_1$ is formed on the surface of intermediate transfer medium 105' in this embodiment as well. This unfixed toner image $T_1$ is conveyed by the revolution of intermediate transfer medium 105, overlapped with transfer medium P, which is conveyed via paper guide 114, and inserted into the nip part formed by secondary transfer roll 111' and pressure roll 112'.

At the surface of secondary transfer roll 111', the heat generating layer 116*b* of secondary transfer roll 111' is made to generate heat by the eddy current generated by the magnetic field from the electromagnetic induction heating device 113', thereby heating the unfixed toner image $T_1$ formed on the peripheral surface of intermediate transfer medium 105 and causing the toner to enter the molten state. At the same time, intermediate transfer medium 105 is overlapped with transfer medium P and pressed by secondary transfer roll 111' and pressure roll 112', and the heat of the surface of secondary transfer roll 111', which is low in heat capacity, is taken away by transfer medium P and cooled rapidly. The toner is thereby solidified and fixed onto recording medium P and a fixed image $T_2$ is thereby obtained.

Though two embodiments, with which the image forming method of the second mode is applied to simultaneous transfer and fixing methods are described above, this invention is not limited to these embodiments, and any known arrangement may be diverted and/or added as long as the arrangements of this invention are provided. Furthermore, the specific numerical values of the two embodiments described above are used for the sake of describing the arrangements and one skilled in the art may design freely in accordance to the desired actions and effects in putting this invention to practice.

Other Processes

The image forming method of this invention is characterized in the fixing process, and only the toner used is specified. With regard to other processes, any of the processes, conditions, and modes that are known as a general art in the field of electrophotography may be applied.

In general, an electrostatic latent image forming process, toner image forming process, transfer process, and fixing process are included. Besides these, a cleaning process, charge removal process, charging process, etc., may be provided as appurtenant processes. With the exception of the fixing processes, the above processes are general processes in themselves and are described for example in Japanese Patent Laid-Open No. 40868/1981, Japanese Patent Laid-Open No. 91231/1974, etc.

In a simultaneous transfer and fixing method, the described transfer and fixing process is applied in place of the transfer process and the fixing process.

EXAMPLES

Though this invention shall now be described more specifically by way of examples, this invention is by no means limited to these examples.

In the following description of the examples, "parts" shall mean "mass parts" unless stated otherwise. The average particle diameter of a toner is measured using a Coulter Counter (Type TA2, made by Beckman Coulter Inc.). Also, the melting point and glass transition temperature of a resin in a toner particle are measured under the condition of a temperature raising rate of 3° C./minute using a differential scanning calorimeter (DSC-50, made by Shimadzu Corp.).

Examples of the First Mode

Preparation of Resin Particle Dispersion (1)

Sebacic acid: 757.6 parts

Ethylene glycol: 300.2 parts

Propylene glycol: 20.0 parts

Sodium isophthalate-5-sulfonate: 201.0 parts

Fumaric acid: 58.0 parts

Dibutyltin: 2.0 parts (The above are made by Wako Pure Chemicals Ltd.)

The above materials are mixed in a flask and heated to 240° C. under reduced pressure atmosphere to perform 6 hours of dehydration condensation. A resin is thereby obtained. The melting point of the cooled resin is 71° C. 150 parts of this resin is then placed in 850 parts of distilled water and mixed and stirred using a homogenizer (Ultra Turrax, made by IKA Japan Inc.) while heating at 85° C. to obtain resin particle dispersion (1).

Preparation of Resin Particle Dispersion (2)

Adipic acid: 632.4 parts

Sebacic acid: 21.6 parts

Ethylene glycol: 310.5 parts

Sodium isophthalate-5-sulfonate: 201.0 parts

Fumaric acid: 58.0 parts

Dibutyltin: 2.5 parts (The above are made by Wako Pure Chemicals Ltd.)

Upon subjecting the above materials to dehydration condensation under the same conditions as resin particle dispersion (1), a resin with a melting point of 65° C. is obtained. This resin is stirred and mixed under the same conditions as resin particle dispersion (1) to obtain resin particle dispersion (2).

Preparation of Resin Particle Dispersion (3)

Eicosanic acid: 1282.5 parts

Decanediol: 760.0 parts

Ethylene glycol: 33.5 parts

Sodium isophthalate-5-sulfonate: 201.0 parts

Fumaric acid: 58.0 parts

Dibutyltin: 2.0 parts (The above are made by Wako Pure Chemicals Ltd.)

Upon subjecting the above materials to dehydration condensation under the same conditions as resin particle dispersion (1), a resin with a melting point of 88° C. is obtained. This resin is stirred and mixed under the same conditions as resin particle dispersion (1) to obtain resin particle dispersion (3).

Preparation of Colorant Dispersion (1)

Phthalocyanine pigment (PV Fast Blue, made by Dainichiseika Color & Chemicals Mfg. Co., Ltd.): 250 parts Anion surfactant (Pionin A-44, made by Takemoto Oil & Fat Co., Ltd.): 10 parts Ion-exchanged water: 740 parts The above materials are mixed, dissolved, and then dispersed using a homogenizer (Ultra Turrax, made by IKA Inc.) to prepare a colorant dispersion (1) in which a colorant (phthalocyanine pigment) is dispersed.

Preparation of Colorant Dispersion (2)

Yellow pigment (PY180, made by Clariant Japan Co., Ltd.): 200 parts

Anion surfactant (Tracks K-300, made by NOF Corp.): 20 parts

Ion exchanged water: 780 parts

The above materials are mixed, dissolved, and then dispersed using a homogenizer (Ultra Turrax, made by IKA Inc.) to prepare a colorant dispersion (2) in which a colorant (yellow pigment) is dispersed.

Preparation of Colorant Dispersion (3)

Magenta pigment (PR122, made by Dainichiseika Color & Chemicals Mfg. Co., Ltd.): 300 parts Anion surfactant (Diapon S, made by NOF Corp.): 22 parts Ion-exchanged water: 678 parts The above materials are mixed, dissolved, and then dispersed using a homogenizer (Ultra Turrax, made by IKA Inc.) to prepare a colorant dispersion (3) in which a colorant (magenta pigment) is dispersed.

Preparation of Colorant Dispersion (4)

Carbon black (Regal 330, made by Cabot Corp.): 230 parts

Anion surfactant (Persoft SFT, made by NOF Corp.): 25 parts

Ion-exchanged water: 745 parts

The above materials are mixed, dissolved, and then dispersed using a homogenizer (Ultra Turrax, made by IKA Inc.) to prepare a colorant dispersion (4) in which a colorant (carbon black) is dispersed.

Preparation of Release Agent Dispersion

Polyethylene wax (Rikemarl B-200, made by Riken Vitamin Co., Ltd.): 300 parts

Anionic surfactant (New Rex R, made by NOF Corp.): 20 parts

Ion-exchanged water: 680 parts

The above materials are mixed, dissolved, dispersed using a homogenizer (Ultra Turrax, made by IKA Inc.), and then subject to dispersion treatment with a pressure discharge type homogenizer to prepare a release agent dispersion in which release agent particles are dispersed.

Preparation Example of Developer (1)

Aggregation Process

Preparation of Aggregated Particles

Resin particle dispersion (1): 586.7 parts

Colorant dispersion (1): 450.0 parts

Release agent dispersion: 15.5 parts

Lauroyl peroxide: 3.0 parts

Aluminum sulfate: 1.1 parts (The above are made by Wako Pure Chemicals Ltd.)

Ion-exchanged water: 100 parts

The above materials are placed in a round, stainless-steel flask, adjusted to 2.5 in pH, dispersed using a homogenizer (Ultra Turrax T50, made by IKA Inc.), and heated to 65° C. while stirring in a heating oil bath. After keeping at 65° C. for 1 hour, the formation of aggregated particles with an average particle diameter of approximately 5.1 μm is confirmed by observation by an optical microscope. After maintaining heating and stirring at 65° C. for another hour, the formation of aggregated particles with an average particle diameter of approximately 5.4 μm is confirmed by observation by an optical microscope. The pH of the aggregated particles is 2.5.

Coalescence Process

An aqueous solution, in which sodium carbonate (made by Wako Pure Chemicals Ltd.) is diluted to 0.5 mass %, is added gently and after adjusting the pH to 5.3, heating to 80° C. is performed while stirring. This condition is maintained for 2 hours.

Thereafter, the reaction product is filtered, washed adequately with ion-exchanged water, and dried using a vacuum dryer. Toner particles are thus obtained.

The toner particles obtained have a volume average particle diameter of 5.5 μm and a number average particle diameter of 4.0 μm. To 100 parts of the toner particles obtained, 1 part of colloidal silica (R972, made by Nippon Aerosil Co., Ltd.) is added externally, and by then mixing using a Henschel mixer, toner (1) is obtained.

Production of Carrier 0.12 mass parts of carbon black (trade name: VXC-72, made by Cabot Corp.) is mixed with 1.25 mass parts of toluene, and to the carbon dispersion obtained by stirring and dispersing for 20 minutes using a sand mill, 1.25 mass parts of a 80 mass % solution of trifunctional isocyanate in ethyl acetate (Takeneto D 110N, made by Takeda Chemical Industries Ltd.) is mixed and stirred in to obtain a coating resin solution. This coating resin solution and 100 mass parts of Mn—Mg—Sr ferrite particles (average particle diameter: 35 μm) are loaded into a kneader, and after mixing and stirring at room temperature for 5 minutes, the temperature is raised to 150° C. under atmospheric pressure to distill off the solvent. After mixing and stirring further for 30 minutes, the power of the heater is turned off and the temperature is lowered to 50° C. The coated carrier obtained is sieved using a 75 μm mesh to prepare a nitrogen-containing resin coated carrier.

Preparation of Developer 5 mass parts of the toner (1) and 95 mass parts of the nitrogen-containing resin coated carrier, obtained as described above, are placed in a V blender, stirred for 20 minutes, and then sieved with a 105 μm mesh. Developer (1) is thus prepared.

Preparation Example of Developer (2)

Aggregation Process

Preparation of Aggregated Particles

Resin particle dispersion (2): 586.7 parts

Colorant dispersion (1): 450.0 parts

Release agent dispersion: 15.5 parts

Lauroyl peroxide: 10.0 parts

Aluminum sulfate: 1.1 parts (The above are made by Wako Pure Chemicals Ltd.)

Ion-exchanged water: 100 parts

The above materials are placed in a round, stainless-steel flask, adjusted to 2.5 in pH, dispersed using a homogenizer (Ultra Turrax T50, made by IKA Inc.), and heated to 58° C. while stirring in a heating oil bath. After keeping at 58° C. for 2 hours, the formation of aggregated particles with an average particle diameter of approximately 6.1 μm is confirmed by observation by an optical microscope. After maintaining heating and stirring at 58° C. for another hour, the formation of aggregated particles with an average particle diameter of approximately 6.2 μm is confirmed by observation by an optical microscope. The pH of the aggregated particles is 2.4.

Coalescence Process

An aqueous solution, in which sodium carbonate (made by Wako Pure Chemicals Ltd.) is diluted to 0.5 mass %, is added gently and after adjusting the pH to 5.2, heating to 75° C. is performed while stirring and this condition is maintained for 2 hours.

Thereafter, the reaction product is filtered, washed adequately with ion-exchanged water, and dried using a vacuum dryer. Toner particles are thus obtained.

The toner particles obtained have a volume average particle diameter of 6.2 μm and a number average particle diameter of 4.7 μm. Using the toner particles thus obtained, a developer is prepared in the same manner as developer (1). Developer (2) is thus obtained.

Preparation Example of Developer (3)

Aggregation Process

Preparation of Aggregated Particles

Resin particle dispersion (3): 586.7 parts

Colorant dispersion (1): 450.0 parts

Release agent dispersion: 15.5 parts

Lauroyl peroxide: 10.0 parts

Aluminum sulfate: 1.1 parts (The above are made by Wako Pure Chemicals Ltd.)

Ion-exchanged water: 100 parts

The above materials are placed in a round, stainless-steel flask, adjusted to 2.3 in pH, dispersed using a homogenizer (Ultra Turrax T50, made by IKA Inc.), and heated to 85° C. while stirring in a heating oil bath. After keeping at 85° C. for 2 hours, the formation of aggregated particles with an average particle diameter of approximately 4.8 μm is confirmed by observation by an optical microscope. After maintaining heating and stirring at 85° C. for another hour, the formation of aggregated particles with an average particle diameter of approximately 5.2 μm is confirmed by observation by an optical microscope. The pH of the aggregated particles is 2.4.

Coalescence Process

An aqueous solution, in which sodium carbonate (made by Wako Pure Chemicals Ltd.) is diluted to 0.5 mass %, is added gently and after adjusting the pH to 6.3, heating to 95° C. is performed while stirring and this condition is maintained for 2 hours.

Thereafter, the reaction product is filtered, washed adequately with ion-exchanged water, and dried using a vacuum dryer. Toner particles are thus obtained.

The toner particles obtained have a volume average particle diameter of 5.4 μm and a number average particle diameter of 3.9 μm. Using the toner particles thus obtained, a developer is prepared in the same manner as developer (1). Developer (3) is thus obtained.

Preparation Example of Developer (4)

Aggregation Process

Preparation of Aggregated Particles

Resin particle dispersion (1): 566.7 parts

Colorant dispersion (2): 400.0 parts

Release agent dispersion: 16.5 parts

Lauroyl peroxide: 10.0 parts

Aluminum sulfate: 1.1 parts (The above are made by Wako Pure Chemicals Ltd.)

Ion-exchanged water: 100 parts

The above materials are placed in a round, stainless-steel flask, adjusted to 2.3 in pH, dispersed using a homogenizer (Ultra Turrax T50, made by IKA Inc.), and heated to 65° C. while stirring in a heating oil bath. After then keeping at 85° C. for 2 hours, the formation of aggregated particles with an average particle diameter of approximately 4.8 μm is confirmed by observation by an optical microscope. After maintaining heating and stirring at 80° C. for another hour, the formation of aggregated particles with an average particle diameter of approximately 5.2 μm is confirmed by observation by an optical microscope. The pH of the aggregated particles is 2.4.

Coalescence Process

An aqueous solution, in which sodium carbonate (made by Wako Pure Chemicals Ltd.) is diluted to 0.5 mass %, is added gently and after adjusting the pH to 6.3, heating to 80° C. is performed while stirring and this condition is maintained for 2 hours.

Thereafter, the reaction product is filtered, washed adequately with ion-exchanged water, and dried using a vacuum dryer. Toner particles are thus obtained.

The toner particles obtained have a volume average particle diameter of 5.4 μm and a number average particle diameter of 3.9 μm. Using the toner particles thus obtained, a developer is prepared in the same manner as developer (1). Developer (4) is thus obtained.

Preparation Example of Developer (5)

Aggregation Process

Preparation of Aggregated Particles

Resin particle dispersion (1): 566.7 parts

Colorant dispersion (3): 333.0 parts

Release agent dispersion: 16.5 parts

Lauroyl peroxide: 9.0 parts

Aluminum sulfate: 1.1 parts (The above are made by Wako Pure Chemicals Ltd.)

Ion-exchanged water: 100 parts

The above materials are placed in a round, stainless-steel flask, adjusted to 2.5 in pH, dispersed using a homogenizer (Ultra Turrax T50, made by IKA Inc.), and heated to 65° C. while stirring in a heating oil bath. After keeping at 65° C. for 2 hours, the formation of aggregated particles with an average particle diameter of approximately 5.2 μm is confirmed by observation by an optical microscope. After maintaining heating and stirring at 65° C. for another hour, the formation of aggregated particles with an average particle diameter of approximately 5.4 μm is confirmed by observation by an optical microscope. The pH of the aggregated particles is 2.6.

Coalescence Process

An aqueous solution, in which sodium carbonate (made by Wako Pure Chemicals Ltd.) is diluted to 0.5 mass %, is added gently and after adjusting the pH to 6.6, heating to 80° C. is performed while stirring and this condition is maintained for 2 hours.

Thereafter, the reaction product is filtered, washed adequately with ion-exchanged water, and dried using a vacuum dryer. Toner particles are thus obtained.

The toner particles obtained have a volume average particle diameter of 5.5 μm and a number average particle diameter of 4.0 μm. Using the toner particles thus obtained, a developer is prepared in the same manner as developer (1). Developer (5) is thus obtained.

Preparation Example of Developer (6)

Aggregation Process

Preparation of Aggregated Particles

Resin particle dispersion (1): 580.0 parts

Colorant dispersion (4): 150.0 parts

Release agent dispersion: 20.5 parts

Lauroyl peroxide: 9.0 parts

Aluminum sulfate: 1.1 parts (The above are made by Wako Pure Chemicals Ltd.)

Ion-exchanged water: 100 parts

The above materials are placed in a round, stainless-steel flask, adjusted to 2.6 in pH, dispersed using a homogenizer (Ultra Turrax T50, made by IKA Inc.), and heated to 65° C. while stirring in a heating oil bath. After keeping at 65° C. for 2 hours, the formation of aggregated particles with an average particle diameter of approximately 5.0 μm is confirmed by observation by an optical microscope. After maintaining heating and stirring at 65° C. for another hour, the formation of aggregated particles with an average particle diameter of approximately 5.2 μm is confirmed by observation by an optical microscope. The pH of the aggregated particles is 2.6.

Coalescence Process

An aqueous solution, in which sodium carbonate (made by Wako Pure Chemicals Ltd.) is diluted to 0.5 mass %, is added gently and after adjusting the pH to 7.0, heating to 80° C. is performed while stirring and this condition is maintained for 2 hours.

Thereafter, the reaction product is filtered, washed adequately with ion-exchanged water, and dried using a vacuum dryer. Toner particles are thus obtained.

The toner particles obtained have a volume average particle diameter of 5.6 μm and a number average particle diameter of 4.1 μm. Using the toner particles thus obtained, a developer is prepared in the same manner as developer (1). Developer (6) is thus obtained.

Preparation of Image Forming Device

The fixing machine part of an "Acolor 930" copier, manufactured by Fuji Xerox Co., Ltd., is taken out to be used for the image forming apparatus of the "Example of the First Mode." Also, the heating roll and the release oil supplier inside the fixing machine that was detached are removed and a hollow aluminum member, with a thickness of 1.5 mm and the same length and diameter as the heating roll, is prepared. Meanwhile, an epoxy resin, having an aluminum oxide powder mixed in at an amount of 50 mass %, is coated to a thickness of 5 to 10 μm on one side of a polyimide film of 20 μm thickness and thereafter adequately dried at 150° C. to prepare a polyimide film having a resistive heat generator layer on one side.

The polyimide film with resistive heat generator layer on one side is wound around and fixed by an adhesive agent to the hollow aluminum member so that the resistive heat generator layer is disposed at the outer side. Conductive rings are fixed to both ends of this roller and a release layer is formed by covering the heating roll surface at the inner side of the conductive rings at both ends with a film (thickness: 5 μm) of an ethylene—vinylidene fluoride—tetrafluoroethylene copolymer. A heating roll is thus prepared.

The heating roll thus obtained is fixed to the abovementioned fixing device, conductive brushes are set so as to contact the conductive rings at both ends, and an electric current is supplied to the conductive brushes from an external power supply. Also, the heat generating part of the pressing roll is removed. A fixing device for the embodiment is thus prepared. With the heating roll of this fixing device, the contact angle with water at 25° C. is 96° and the arithmetic mean roughness (Ra) as determined according to the method of JIS B 0601 is 1.5 μm.

Example 1

Developer (1) is placed in the developer of the image forming apparatus and an unfixed toner image with a solid part is formed. As the recording medium, color copy paper (J paper), made by Fuji Xerox Co., Ltd. is used, and after forming the unfixed image, the recording medium is preserved for 1 day under high-temperature, high-humidity conditions (30° C., 90% RH). Fixing of this image is then performed under the abovementioned high-temperature, high-humidity conditions upon adjusting the rotation speed of the heating roll of the fixing machine, described in the "(Preparation of Image Forming Device)" section, so that the time of contact of the heating roll and the unfixed toner image will be 0.04 seconds and setting the surface temperature of the heating roll to 115° C. For evaluation, fixing of the unfixed image is performed continuously on 10 sheets of the recording medium, and with the 10th fixed image, an inward fold is made so that the fold will come at substantially the center of the fixed image of the solid part to evaluate the destruction of the fixed image and check the level of fixing. Also, the non-uniformity of gloss is evaluated visually. Furthermore, the fixed image is rubbed ten times across using a rubber eraser (ST-100, made by Taguchi Rubber Industry Co., Ltd.) and whether or not the fixed image becomes rubbed off the paper is evaluated. The results are shown in Table 2 below.

Example 2

Besides using developer (2) in place of the developer (1) in Example 1, fixing is performed and evaluations are carried out in the same manner as in Example 1. The results are shown in Table 2 below.

Example 3

Besides using developer (3) in place of the developer (1) in Example 1, fixing is performed and evaluations are carried out in the same manner as in Example 1. The results are shown in Table 2 below.

Example 4

Besides using developer (4) in place of the developer (1) in Example 1, fixing is performed and evaluations are carried out in the same manner as in Example 1. The results are shown in Table 2 below.

Example 5

Besides using developer (5) in place of the developer (1) in Example 1, fixing is performed and evaluations are carried out in the same manner as in Example 1. The results are shown in Table 2 below.

Example 6

Besides using developer (6) in place of the developer (1) in Example 1, fixing is performed and evaluations are carried out in the same manner as in Example 1. The results are shown in Table 2 below.

Comparative Example 1

Besides using a developer for "Acolor 930" as it is as the developer in Example 1, fixing is performed and evaluations are carried out in the same manner as in Example 1. The results are shown in Table 2 below. For the binder resin in the toner of the developer for "Acolor 930", the ester concentration is 0.0870 and the below-described melt viscosity (120° C.) is 5200Pa·S.

Comparative Example 2

Besides using the fixing device for "Acolor 930" as the fixing device in Example 1, fixing is performed and evaluations are carried out in the same manner as in Example 1. The results are shown in Table 2 below.

For each of the above described developer preparation examples 1 through 6, the number average molecular weight of the THF soluble part of the crystalline resin, which was subject to the production of the toner used, and the characteristics of the toner used are shown in Table 1. The fixing machine warming-up time, fixing characteristics, and melt viscosity values for Examples 1 through 6 and Comparative Examples 1 and 2 are shown in Table 2.

Tm indicates the toner melting point, G'30 indicates the storage elastic modulus at 30° C., G'(Tm) and G'(Tm+10) indicate the storage elastic moduli at the melting point and melting point+10° C., respectively, and G"(Tm) and G"(Tm+10) indicate the loss elastic moduli at the melting point and melting point+10 C., respectively. For the melt viscosity, the value obtained by dividing the loss elastic modulus G' at 120° C. by the measurement frequency of 1 rad/sec is indicated as the melt viscosity.

Furthermore, the warming-up time of the fixing device can be shortened and adequate effects are obtained in fixing even under high-temperature, high-humidity conditions wherein the temperature of the heating roll surface tends to vary readily.

Examples of the Second Mode

Example 7

Synthesis of Crystalline Polyester Resin

After placing 17.4 mass parts of 1,10-decanediol, 2.2 mass parts of sodium dimethyl 5-sulfoisophthalate, 10 mass parts of dimethyl sulfoxide, and 0.03 mass parts of dibutytin oxide as catalyst in a heat-dried, three-necked flask, the air inside the container is made an inert atmosphere of nitrogen gas by a pressure reducing operation and stirring at 180° C. is performed for 3 hours by mechanical stirring. The dimethyl sulfoxide is then distilled off under reduced pressure, 26.5 mass parts of dimethyl dodecanedioate are added under a flow of nitrogen, and stirring at 180° C. is performed for 1 hour.

TABLE 1

| Developer preparation example | Mn* | Ester concentration | Melt viscosity (Pa · S) | Tm/ ° C. | G'30/×10$^5$ | G'(Tm)/ ×10$^5$ | G'(Tm + 10)/ ×10$^3$ | G"(Tm)/ ×10$^5$ | G"(Tm + 10)/ ×10$^3$ | ΔLogG' | ΔLogG" |
|---|---|---|---|---|---|---|---|---|---|---|---|
| 1 | 4200 | 0.142 | 800 | 71 | 3.4 | 3.0 | 7.7 | 3.0 | 7.5 | 1.4 | 1.3 |
| 2 | 2800 | 0.198 | 2100 | 65 | 4.0 | 3.6 | 5.2 | 3.3 | 4.6 | 1.8 | 1.2 |
| 3 | 6100 | 0.0643 | 4400 | 88 | 6.3 | 6.0 | 2.3 | 5.5 | 1.9 | 1.9 | 1.6 |
| 4 | 4200 | 0.142 | 850 | 71 | 3.3 | 2.8 | 6.8 | 2.8 | 6.0 | 1.2 | 1.0 |
| 5 | 4200 | 0.142 | 810 | 71 | 3.2 | 2.6 | 5.1 | 2.8 | 4.8 | 1.3 | 1.2 |
| 6 | 4200 | 0.142 | 870 | 71 | 3.4 | 3.1 | 8.1 | 3.1 | 7.7 | 1.4 | 0.9 |

*Mn: number average molecular weight of crystalline resin used as the main component of the binder resin in the toner

TABLE 2

| | Volume average particle diameter of toner/μm | Warming-up time (minutes) | Fixing level | Gloss | Attachment to paper |
|---|---|---|---|---|---|
| Example 1 | 5.5 | 1 | Good | Good | Good |
| Example 2 | 6.2 | 1 | Good | Good | Good |
| Example 3 | 5.4 | 1 | Good | Good | Good |
| Example 4 | 5.4 | 1 | Good | Good | Good |
| Example 5 | 5.5 | 1 | Good | Good | Good |
| Example 6 | 5.6 | 1 | Good | Good | Good |
| Comparative Example 1 | 7.1 | 1 | Offset occurred. | Could not evaluate. | Good |
| Comparative Example 2 | 5.5 | 4 | Good | Slightly non-uniform | Good |

The following are clear from the results shown in Tables 1 and 2.

That is, with the image forming methods of Examples 1 through 6, wherein a toner containing a binder resin having a crystalline resin as the main component is used, a fixing device having a resistive heat generator layer in the heating roll is used, and the temperature of the surface of the heating roll is set in the range of 80 to 120° C., results that are good in terms of low-temperature fixing property are obtained in comparison to Comparative Example 1. Also, with these Examples, results that are good in terms of the fixing level (gloss) are obtained in comparison to Comparative Example 2, wherein the toner is provided with a low-temperature fixing property and fixing is performed using a heating roll that performs heating by radiant heat.

Also with regard to attachment to paper, good results are obtained due to the ester concentrations in the Examples and Comparative Examples being in the range of 0.01 to 0.2.

Thereafter under reduced pressure, the temperature is raised gradually to 220° C., stirring is performed for 30 minutes, and when a viscous state is reached, cooling with air is performed to stop the reaction. 36 mass parts of a crystalline polyester resin (1) is thereby synthesized.

The weight average molecular weight ($M_w$) and the number average molecular weight ($M_n$) of the obtained crystalline polyester resin (1), as determined by molecular weight measurement by GPC (polystyrene equivalent), are 9200 and 6000, respectively.

Also, when the melting point (Tm) of crystalline polyester resin (1) is measured by the abovementioned measurement method using a differential scanning calorimeter (DSC), a clear peak is exhibited. The peak top temperature is 79° C.

Preparation of Toner

Preparation of Resin Particle Dispersion 150 parts of the crystalline polyester resin (1) are placed in 850 parts of distilled water and mixing and stirring by a homogenizer (Ultra Turrax, made by IKA Japan Inc.) are performed while heating at 85° C. to obtain a resin particle dispersion.

Preparation of Colorant Dispersion

Next, after mixing and dissolving 250 parts of phthalocyanine pigment (PV Fast Blue, made by Dainichiseika Color & Chemicals Mfg. Co., Ltd.), 20 parts of anion surfactant (Neogen RK, made by Dai-ichi Kogyo Seiyaku Co., Ltd.), and 730 parts of ion-exchanged water, the mixture is dispersed using a homogenizer (Ultra Turrax, made by IKA Inc.), thereby preparing a colorant dispersion in which a colorant (phthalocyanine pigment) is dispersed.

Preparation of Release Agent Dispersion

Also, 100 mass parts of paraffin wax, 25 parts of anion surfactant (Neogen RK, made by Dai-ichi Kogyo Chemicals Co., Ltd.), and 200 parts of ion-exchanged water are mixed and then dispersed at 80° C. using a homogenizer (Ultra Turrax, made by IKA Inc.) to prepare a release agent dispersion.

Aggregation Process 2400 parts of the resin particle dispersion, 100 parts of the colorant dispersion, and 63 parts of the release agent dispersion obtained in the above manner, are placed along with 10 parts of lauroyl peroxide, 5 parts of aluminum sulfate (made by Wako Pure Chemicals Ltd.), and 100 parts of ion-exchanged water in a round, stainless steel flask and, after adjusting the pH to 2.0, are dispersed using a homogenizer (Ultra Turrax T50, made by IKA Inc.) and heated to 74° C. while stirring in a heating oil bath. After keeping at 74° C. for 3 hours, the formation of aggregated particles with an average particle diameter of approximately 6.5 μm is confirmed by observation by an optical microscope. After maintaining heating and stirring at 74° C. for another hour, the formation of aggregated particles with an average particle diameter of approximately 7.3 μm is confirmed by observation by an optical microscope. The pH of the aggregated particles is 2.4.

Coalescence Process

An aqueous solution, in which sodium carbonate (made by Wako Pure Chemicals Ltd.) is diluted to 0.5 mass %, is added gently and after adjusting the pH to 5.0, heating to 83° C. is performed while stirring and this condition is maintained for 3 hours. Thereafter, the reaction product is filtered, washed adequately with ion-exchanged water, and dried using a vacuum dryer. Toner (A) is thus obtained.

The volume average particle diameter and the number average particle diameter of the obtained toner (A), as measured using the Coulter Counter Type [TA-II] (aperture diameter: 50 μm; made by Beckman Coulter Inc.), are 7.5 μm and 6.0 μm, respectively.

Evaluation of the Physical Properties (Viscoelasticity) of Toner (A)

The viscoelasticity of the toner (A) obtained is measured using a rotating plate type rheometer (RDA 2RHIOS System Ver. 4.3.2, made by Rheometerics Scientific FE).

For measurement, the sample is set on the sample holder and measurements are made at a temperature raising rate of 1° C./min, frequency of Irad/s, distortion of 20% or less, and a detection torque within the range guaranteed for measurements. 8 mm and 20 mm sample holders are selected and used as necessary.

The variations of the storage elastic modulus G'(Pa) and loss elastic modulus G"(Pa) with respect to temperature variation are thus obtained. The temperature (T1) at which the viscoelasticity changes suddenly due to glass transition or melting of the polymer is 76° C. and the temperature (T2) at which the viscosity becomes 10000Pa·S is 78° C.

For the binder resin in the toner (A) obtained, the ester concentration is 0.0833 and the melt viscosity (120° C.), as described above in the "Examples of the First Mode" section, is 3500Pa·S.

Preparation of Developer (A)

The nitrogen-containing resin coated carrier, prepared in the preparation example of developer (1) as described in the "Examples of the First Mode" section, and the toner (A) are mixed to prepare a two-component developer (A), with which the toner concentration is 7 mass %.

Preparation of the Image Forming Device

For the "Examples of the Second Mode," the image forming apparatus with electromagnetic induction heating type fixing device, shown in FIG. 6, is used. However, whereas the image forming apparatus shown in FIG. 6 has four image forming units, with the present examples, only the image forming unit 107Y is used for the sake of convenience as tests are conducted only with one toner color.

The operation of the image recording apparatus used in the "Examples of the Second Mode" shall now be described. The monochromatic toner image, which has been electrostatically transferred onto intermediate transfer medium 105 by image forming unit 107Y, passes through the heating area that opposes electromagnetic induction heating device 113 at the upstream side of the nip part formed by the secondary transfer roll 111, which is the secondary transfer unit, and the pressure roll 112. In the heating area, an alternating current is applied to the exciting coil from the exciting circuit and the heat generating layer 116*b* of intermediate transfer medium 105 is made to generate heat by electromagnetic induction heating.

With intermediate transfer medium 105, base 116*a* is a polyimide member with a circumferential length of 800 mm, width of 320 mm, and thickness of 15 μm and a copper member of 2 μm thickness is used as heat generating layer 116*b*. As a release layer 116*c* with good release property, a PFA-coated layer of 5 μm thickness is provided on top of heat generating layer 116*b*.

Meanwhile, electromagnetic induction heating device 113 causes heat generating layer 116*b* to generate heat, and the power consumption in this process is 400W and the warm-up time is 1 minute. As shall be described below, with "FX Acolor", manufactured by Fuji Xerox Co., Ltd., the consumption power is 530W and the warm-up time is 5 minutes. A comparison of the consumption power thus shows the consumption power of the image recording apparatus used in the Examples to be approximately ⅙ to ⅐ that of the abovementioned product.

By the above arrangement, heat generating layer 116*b* is made to generate heat rapidly, this heat is transferred to the surface layer with the elapse of time, and by the time the secondary transfer unit is reached, the toner on the peripheral surface of intermediate transfer medium 105 will have entered the molten state. To be more specific, when the secondary transfer unit is reached, the temperature of the peripheral surface of intermediate transfer medium 105 will be 110° C.

The toner of the toner image that has melted on the peripheral surface of intermediate transfer medium 105 is brought into close contact with recording medium P by the pressure of pressure roll 112, which is pressed in accordance with the conveying of recording medium P at the secondary transfer unit. In the heating area, intermediate transfer medium 105 is heated, in a localized manner at just the vicinity of the surface, to approximately 100° C. or more, which is equal to or greater than the melting point of the toner. The molten toner is then rapidly cooled upon contact with recording medium P, which is at room temperature. Thus in passing through the nip part of the secondary transfer unit, the molten toner permeates and becomes transferred and fixed instantly onto recording medium P by the heat energy possessed by the toner and the pressing force. Recording medium P is then conveyed towards the exit of the nip part while taking away the heat of intermediate transfer medium 105, with which just the toner and the vicinity of the surface has been heated.

For this process, the nip width and the moving speed of recording medium P are set appropriately so that the temperature of the toner at the exit of the nip part will be lower than its melting point. The aggregation force of the toner will thus be large and the toner image will be transferred and fixed onto the recording medium substantially completely without causing offset. Thereafter, the recording medium onto which the toner image has been transferred and fixed is discharged onto discharge tray 115. The image formation is thereby completed.

Evaluations of Image Formation and Fixed Image

The evaluation of image formation is carried out using the developer (A) obtained as described above and the above-mentioned image forming apparatus. A fixed image is obtained under conditions where the toner to be fixed onto the recording medium can separate readily from the intermediate transfer medium and where neither hot offset nor cold offset will occur, and the fixing property of this fixed image is checked for evaluation.

Evaluation of fixing using toner A, containing the above-mentioned crystalline resin, shows that for the toner image in the molten state on the belt, the lower limit temperature, at which the fixing level of the obtained fixed image will be good, is approximately 110 C. For the evaluation of fixing, a solid image for which the toner weight per 1 $cm^2$ is 0.9($mg/cm^2$) is formed and fixed on an A4-size J paper, made by Fuji Xerox. The fixing level is judged to be good when after folding and then opening the fixed image part, the image remains firmly at both non-folded parts and folded parts even when the solid image is rubbed. The fixing is performed with a process speed of 160 mm/sec and a nip width of 10 mm. Paper for color copying (J paper), made by Fuji Xerox Co., Ltd., is used as the recording medium.

The quantity of input power in this process is 530W. This input power quantity is used as a standard and the same power quantity is input in the image forming apparatus of the comparative examples described below to compare the image forming performance (fixing level). The property of attachment of the fixed image onto paper is also evaluated by the same method as described above. The obtained results are shown in Table 3 below.

Comparative Example 3

Preparation of Toner Containing a Non-Crystalline Polyester Resin

Preparation of Phthalocyanine Flush Pigment 70 mass parts of a polyester resin (bisphenol A type polyester: bisphenol A ethylene oxide adduct—cyclohexanedimethanol—terephthalic acid, weight average molecular weight: 11,000, number average molecular weight: 3,500, Tg: 65° C.) and 75 mass parts of a paste containing phthalocyanine pigment (PB 15:3) (pigment content: 40 mass %) are placed and mixed in a kneader type kneading machine and heated gradually. Kneading is continued at 120° C. and after separation of the aqueous phase and the resin layer, the water is removed, and thereafter, the resin layer is dehydrated by kneading further to remove the water. A phthalocyanine flush pigment is thereby obtained.

Preparation of Phthalocyanine-Colored Particles 67 mass parts of a polyester resin (bisphenol A type polyester: bisphenol A ethylene oxide adduct—cyclohexanedimethanol—terephthalic acid, weight average molecular weight: 11,000, number average molecular weight: 3,500, Tg: 65° C.), 33 mass parts of the phthalocyanine flush pigment, and 10 mass parts of refined carnauba wax are melted and kneaded using a Banbury mixer, and after cooling, pulverizing by a jet mill and classification by an air classifier are performed to obtain a toner (B) that is made up of phthalocyanine-colored particles.

Evaluation of the Physical Properties (Viscoelasticity) of Toner (B)

Evaluation of the physical properties (viscoelasticity) of toner (B) is carried out in the same manner as in Example 7 to determine T1 and T2. The results are shown in Table 3 below. For the binder resin in toner (B), the ester concentration is 0.0870 and the melt viscosity (120° C.), as described above in the "Examples of the First Mode" section, is 5500Pa·S.

Preparation of Developer (B)

The ferrite carrier, prepared in the preparation example of developer (1) as described above in the "Examples of the First Mode" section, and the toner (B) are mixed to prepare a two-component developer (B) with a toner concentration of 7 mass %.

Evaluations of Image Formation and Fixed Image

Besides using the developer (B) obtained as described above, the image formation and the fixed image are evaluated using the image forming apparatus with electromagnetic induction heating type fixing device in the same manner as in Example 7. The results are shown below in Table 3.

Comparative Example 4

Using the developer (A) obtained in Example 7 and using "FX Acolor", made by Fuji Xerox Co., Ltd., as the image forming apparatus, the image formation and the fixed image are evaluated in the same manner as in the evaluations of image formation and fixed image carried out for Example 7. Here, only the same quantity of power (530W) as in Example 7 is input into the fixing device of "FX Acolor", made by Fuji Xerox Co., Ltd. The results are shown below in Table 3.

The fixing device of "FX Acolor", made by Fuji Xerox Co., Ltd., has the following arrangement.

Heating roll (50 mm diameter) . . . Core roller: aluminum, 44 mm inner diameter, coating layer: silicone rubber (inner side, 3 mm thickness), fluororubber (outer side, 40 μm thickness, 40 degrees hardness)

Pressure roll (50 mm diameter) . . . Core roller: aluminum, 44 mm inner diameter, coating layer: fluororubber (3 mm thickness, 45 degrees hardness)

Process speed . . . 160 mm

Nip width . . . 10 mm

Comparative Example 5

Using the developer (B) obtained in Comparative Example 3 and using "FX Acolor", made by Fuji Xerox Co., Ltd., as the image forming apparatus, the image formation and the fixed image are evaluated in the same manner as in the evaluations of image formation and fixed image carried out for Example 7. Here, only the same quantity of power (530W) as in Example 7 is input into the fixing device of "FX Acolor", made by Fuji Xerox Co., Ltd. The results are shown below in Table 3. The fixing device of "FX Acolor", made by Fuji Xerox Co., Ltd., is as has been described with regard to Comparative Example 4.

TABLE 3

| | Example 7 | Comparative Example 3 | Comparative Example 4 | Comparative Example 5 |
|---|---|---|---|---|
| Fixing device type | Electromagnetic induction type | Electromagnetic induction type | Heating · pressure roll type | Heating · pressure roll type |
| Resin type | Crystalline resin | Non-crystalline resin | Crystalline resin | Non-crystalline resin |
| Viscoelasticity (sharp melting property) | | | | |
| T1 (° C.) | 76 | 65 | 76 | 65 |
| T2 (° C.) | 78 | 122 | 78 | 122 |
| Fixing level | Good | Poor | Good | Poor |

The results of Table 1 show that with regard to the viscoelasticity measurement results, the toners containing crystalline resins used in Example 7 and Comparative Example 4 exhibit a small temperature difference of 5° C. or less between T1 and T2 and exhibit a sudden change in viscoelasticity with respect to temperature due to the crystallinity. Also, since the melting point of the toner containing the crystalline resin used is a low temperature of 80° C., the temperature of the fixer necessary for fixing is confirmed to be lowered by 40° C. or more in comparison to the case where a toner that contains a non-crystalline resin is used.

The results of evaluating the image formation in Comparative Example 3, Comparative Example 4, and Comparative Example 5 using the same power quantity as the input power quantity in Example 7 show the fixing level to be poor in all of these comparative examples.

Though in Example 7 and Comparative Example 3, an electromagnetic induction heat-fixing type fixing device, which is the second mode of this invention, is used, in Comparative Example 3, since the toner that is employed is such that the temperature reaching the melt viscosity, at which fixing onto the recording medium is enabled, is 40° C. or higher than that of the toner used in Example 7, a molten state that is sufficient for fixing cannot be attained and the fixing level is poor with the same quantity of input power as Example 7.

Also with Comparative Example 4 and Comparative Example 5, a non-electromagnetic-induction-heating type fixing device is used and, with the same input power quantity as the fixing device of Example 7, the temperature cannot be raised adequately for the heating device to melt the toner due to the heat capacity of the heating device itself. The fixing level of the fixed image is thus evaluated as being poor.

As has been described above, with an image recording apparatus that uses an electromagnetic induction heat-fixing type fixing device, since the unfixed toner image is heated and melted by the generation of heat by the electromagnetic induction heat generating layer, the parts that are heated are the heat generating layer in the vicinity of the peripheral surface of the intermediate transfer medium, the release layer formed above the heat generating layer, and the toner, and materials of low heat conductivity are used in the base and other parts that are located below the heat generating layer, the toner can be melted adequately without hardly heating the parts located below the heat generating layer.

Also, since the toner that is used in this invention contains a crystalline resin, which enters the molten state at a fixing temperature of 120° C. at which low-temperature fixing is achieved and preferably 110° C. and more preferably 100° C. or less, the toner is low in melting temperature and is small in the difference between the temperature at which melting starts and the temperature at which a melt viscosity suitable for fixing is attained. Thus in comparison to a prior-art toner that contains an amorphous resin, the toner can be put in the molten state at a lower temperature and in a shorter time, thereby enabling the energy used to be reduced and doing away with the need for preheating, which in turn does away with the need to set a standby time in the process of switching ON the power of the image recording apparatus and starting the image forming operation.

Also, the molten toner, by being adequately heated, becomes attached to the unheated recording medium when pressed against the recording medium and thereafter drops in temperature due to the heat being taken away by the recording medium. In this process, only a limited part of the intermediate transfer medium at the peripheral surface side of the heat generating layer is at a high temperature, and since the amount of heat held by the toner and intermediate transfer medium is low, the above-mentioned temperature drop occurs rapidly. This causes the crystalline-resin-containing toner, which has been in the molten state, to solidify by recrystallization when the temperature of the toner reaches approximately (Tm−10) ° C.

Also, with the image recording apparatus using an electromagnetic induction heat-fixing type fixing device, since a fluctuating magnetic field is made to act on a heat generating layer that is disposed in the vicinity of the peripheral surface of the intermediate transfer medium and heat energy is provided by the generation of heat due to the eddy current that is generated in the heat generating layer, the vicinity of the peripheral surface of the intermediate transfer medium can be heated selectively to melt the toner of an unfixed toner image and yet prevent the accumulation of heat inside the apparatus in accompaniment with the raising of the temperature of the intermediate transfer medium. Output images can thus be obtained in a stable manner without causing changes in the characteristics of the intermediate transfer medium.

Furthermore, since the efficiency of use of heat energy is extremely high, the energy consumption of the apparatus as a whole can be reduced and high-speed image formation can be performed with limited power. Furthermore, since the warm-up time is practically done away with, the power that is input during standby of the apparatus to keep the heating member at a set temperature can be omitted.

The entire disclosure of Japanese Patent Application No. 2001-187367 filed on Jun. 20, 2001 including specification, claims, drawings and abstract is incorporated herein by reference in its entirety.

What is claimed is:

1. An image forming method, comprising the step of heating a heating member that is in contact with a toner image to fix the toner image onto a recording medium, wherein a surface of the heating member or vicinity thereof generates a heat, and a toner forming the toner image contains a colorant and a binder resin containing a crystalline polyester resin as the main component, the crystalline polyester resing giving a number average molecular weight of approximately 1500 or more, and ester concentration M, as defined by the following equation (1), of the crystalline polyester resin is approximately 0.01 or more and 0.2 or less:

$$M=K/A \quad (1)$$

where M represents the ester concentration, K represents the number of ester groups in the polymer, and A represents the number of atoms that constitute the macromolecular chain of the polymer.

2. The image forming method as set forth in claim 1, wherein the heating member is a roller and has a resistive heat generator layer on the surface or vicinity of the surface, the generator layer generating the heat upon passage of current.

3. The image forming method as set forth in claim 1, wherein the heating member comprises a conductive material that generates the heat by an eddy current generated by applying a magnetic field to the conductive material.

4. The image forming method as set forth in claim 1, wherein the number average molecular weight of the crystalline polyester resin is approximately 4000 or more.

5. The image forming method as set forth in claim 1, wherein a melting point of the crystalline polyester resin is in the range of approximately 50 to 120 C.

6. The image forming method as set forth in claim 1, wherein a melting point of the crystalline polyester resin is in the range of approximately 60 to 110 C.

7. The image forming method as set forth in claim 1, wherein a melt viscosity of the toner at a temperature of 120° C. is approximately 100 Pa·S or more.

8. The image forming method as set forth in claim 1, wherein the crystalline resin makes up 70 mass % of the binder resin.

9. The image forming method as set forth in claim 1, wherein the crystalline resin makes up 90 mass % of the binder resin.

10. The image forming method as set forth in claim 1, wherein the crystalline polyester resin is an aliphatic polyester resin.

11. The image forming method as set forth in claim 1, wherein the toner has inorganic particles added internally.

12. The image forming method as set forth in claim 11, wherein the amount of the internally added inorganic particles is in the range of approximately 0.5 to 15 mass %.

13. The image forming method as set forth in claim 1, wherein the toner has a release agent added internally at an amount of approximately 0.5 to 50 mass %.

14. The image forming method as set forth in claim 1, wherein the toner has a storage elastic modulus $G_L(30)$ of approximately $1\times10^6$ Pa or more and a loss elastic modulus $G_N(30)$ of approximately $1\times10^6$ Pa or more at an angular frequency of 1 rad/sec and a temperature of 30° C.

15. The image forming method as set forth in claim 1, wherein the toner has a temperature area in which the values of the storage elastic modulus $G_L$ and loss elastic modulus $G_N$ change approximately 1000 or more within a range of temperature change of 10° C.

16. The image forming method as set forth in claim 1, wherein the toner has two or more external additives and the average primary particle size of at least one of the external additives is within the range of approximately 30 nm to 200 nm.

17. The image forming method as set forth in claim 1, wherein the toner image is developed by a developer comprising the toner and a carrier having a nitrogen-containing resin coating.

18. The image forming method as set forth in claim 17, wherein the nitrogen-containing resin is selected from a group consisting of a urea resin, a urethane resin, a melamine resin and an amide resin.

* * * * *